US008689818B2

(12) United States Patent
Marty et al.

(10) Patent No.: US 8,689,818 B2
(45) Date of Patent: Apr. 8, 2014

(54) WIDESPREAD FAUCET

(75) Inventors: Garry Robin Marty, Fishers, IN (US); Kurt Judson Thomas, Indianapolis, IN (US); Brian Wayne Johnson, Muncie, IN (US); Brian Alan Enlow, Fishers, IN (US); Derek Allen Brown, Lizton, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 599 days.

(21) Appl. No.: 12/995,410

(22) PCT Filed: Jun. 25, 2009

(86) PCT No.: PCT/US2009/048658

§ 371 (c)(1),
(2), (4) Date: Nov. 30, 2010

(87) PCT Pub. No.: WO2009/158498

PCT Pub. Date: Dec. 30, 2009

(65) Prior Publication Data

US 2011/0073205 A1 Mar. 31, 2011

Related U.S. Application Data

(60) Provisional application No. 61/133,029, filed on Jun. 25, 2008.

(51) Int. Cl.
*F16K 21/00* (2006.01)
*E03C 1/04* (2006.01)

(52) U.S. Cl.
USPC ..... 137/315.12; 137/801; 4/678

(58) Field of Classification Search
USPC ..... 137/315.12, 801; 4/675, 678
See application file for complete search history.

(56) References Cited

U.S. PATENT DOCUMENTS

| | | | |
|---|---|---|---|
| 3,736,959 | A | 6/1973 | Parkison |
| 3,788,601 | A | 1/1974 | Schmitt |
| 3,810,602 | A | 5/1974 | Parkinson |
| 3,834,416 | A | 9/1974 | Parkison |
| 3,960,016 | A | 6/1976 | Symmons |
| 4,290,445 | A | 9/1981 | Turner |
| 4,465,259 | A | 8/1984 | Allen et al. |
| 4,604,202 | A | 8/1986 | Movshovitz |
| 4,651,770 | A | 3/1987 | Denham et al. |
| 4,754,783 | A | 7/1988 | Knapp |
| 4,793,375 | A | 12/1988 | Marty |

(Continued)

FOREIGN PATENT DOCUMENTS

| | | |
|---|---|---|
| EP | 1 072 830 | 9/2004 |
| WO | WO 2009/126887 | 10/2009 |
| WO | WO 2009/155529 | 12/2009 |
| WO | WO 2009/158497 | 12/2009 |

OTHER PUBLICATIONS

International Search Report and Written Opinion for PCT Application No. PCT/US2009/048658, issued Aug. 14, 2009, 13 pgs.

*Primary Examiner* — Kevin Lee
(74) *Attorney, Agent, or Firm* — Faegre Baker Daniels LLP

(57) ABSTRACT

A faucet assembly (10, 200, 300) including a waterway (28, 228, 328) fluidly coupled to a valve assembly (26). In one illustrative embodiment, a valve body (54, 206, 306) receives the waterway (28, 228, 328), and at least one retainer (64, 66, 216, 316, 318) restrains movement of the waterway (28, 228, 328).

42 Claims, 20 Drawing Sheets

(56) References Cited

U.S. PATENT DOCUMENTS

| | | | | |
|---|---|---|---|---|
| 4,838,304 | A | 6/1989 | Knapp | |
| 4,971,112 | A | 11/1990 | Knapp | |
| 4,981,156 | A | 1/1991 | Nicklas et al. | |
| 5,010,917 | A | 4/1991 | Iqbal | |
| 5,174,324 | A | 12/1992 | Chrysler | |
| 5,355,906 | A | 10/1994 | Marty et al. | |
| 5,402,827 | A | 4/1995 | Gonzalez | |
| 5,692,536 | A | 12/1997 | Tokarz | |
| 5,725,010 | A | 3/1998 | Marty et al. | |
| 5,832,952 | A | 11/1998 | Cook et al. | |
| 5,896,601 | A | 4/1999 | Humpert et al. | |
| 5,931,374 | A | 8/1999 | Knapp | |
| 5,946,746 | A | 9/1999 | Bloom | |
| 6,345,643 | B1 | 2/2002 | Ko | |
| 6,517,006 | B1 | 2/2003 | Knapp | |
| 6,571,407 | B1 * | 6/2003 | Skarie | 137/801 |
| 6,738,996 | B1 | 5/2004 | Malek et al. | |
| 6,845,526 | B2 | 1/2005 | Malek et al. | |
| 6,880,573 | B2 | 4/2005 | Berkman et al. | |
| 6,959,729 | B2 | 11/2005 | Graber | |
| 7,055,545 | B2 | 6/2006 | Mascari et al. | |
| 7,124,776 | B1 | 10/2006 | Hwang | |
| 7,140,390 | B2 | 11/2006 | Berkman et al. | |
| 7,269,864 | B2 * | 9/2007 | Brown et al. | 4/678 |
| 8,272,083 | B1 * | 9/2012 | Liston et al. | 4/695 |
| 2006/0191580 | A1 | 8/2006 | Sponheimer et al. | |
| 2007/0271695 | A1 | 11/2007 | Thomas et al. | |
| 2009/0078322 | A1 | 3/2009 | Thomas et al. | |

* cited by examiner

WIDESPREAD FAUCET

CROSS-REFERENCE TO RELATED APPLICATION

This application is a national phase filing of PCT International Application Serial No. PCT/US2009/048658, filed Jun. 25, 2009, which claims the benefit of U.S. Provisional Patent Application Ser. No. 61/133,029, filed Jun. 25, 2008, the disclosures of which are expressly incorporated herein by reference.

BACKGROUND AND SUMMARY OF THE INVENTION

The present invention relates to a faucet assembly and, more particularly, to a widespread faucet assembly configured to reduce contaminants, including lead, within waterways.

Faucets are typically controlled by either a single handle which utilizes a mixing valve to proportion the flow of hot and cold water to a faucet spout, or two handles which utilize individual valves to separately control the flow of hot water and cold water to the faucet spout. In the case of the standard prior art mixing valve, two inlets are provided, one each for the hot and cold water supplies. For two handle faucets, each valve typically includes a single inlet opening which fluidly communicates with the flow passageway of a valving member. One type of two handle faucet is a widespread faucet where the hot water valve, the cold water valve and the spout have no common base above the sink deck.

In an illustrative embodiment of the present disclosure, a faucet assembly reduces exposure of potable water to lead or other heavy metal contaminants that could potentially be dissolved from a conventional faucet. Illustratively, a closed ceramic-type valve cartridge mates with an inert polymeric waterway. The waterway illustratively includes supply conduits configured to connect directly to the plumbing system through conventional hot and cold water stops. Water leaving the valve cartridge is directed through non-metallic materials until it exits the faucet through an aerator, thereby reducing, if not eliminating, the potential for contamination of heavy metals.

According to an illustrative embodiment of the present disclosure, a faucet assembly includes a waterway having a conduit with opposing first and second ends, and a base coupled to the first end of the conduit. A valve assembly is operably coupled to the base and is in fluid communication with the conduit. A valve body includes a sidewall receiving the base of the waterway. The valve assembly is operably coupled to an upper end of the valve body, and the conduit extends through a lower end of the valve body. A first retainer is integral with the sidewall of the valve body and is configured to prevent movement of the base of the waterway toward the upper end of the valve body. A second retainer is integral with the sidewall of the valve body and is configured to prevent movement of the base of the waterway toward the lower end of the valve body.

In a further illustrative embodiment of the present disclosure, a faucet assembly includes a waterway having a conduit with opposing first and second ends, and a base coupled to the first end of the conduit. A valve assembly is operably coupled to the base and is in fluid communication with the conduit. A valve body includes a sidewall receiving the base of the waterway. The valve assembly operably couples to an upper end of the valve body, and the conduit extends through a lower end of the valve body. A first orientation member is supported by the base of the waterway. A second orientation member is operably coupled to the first orientation member to facilitate proper rotational orientation of the base of the waterway.

According to another illustrative embodiment of the present disclosure, a widespread faucet assembly includes a hot water control valve, a cold water control valve, a hot water outlet conduit including an end in fluid communication with the hot water control valve, and a cold water outlet conduit including an end in fluid communication with the cold water control valve. A fluid connector includes a hot water inlet port, a cold water inlet port, and an outlet port. The end of the hot water outlet conduit is received within the hot water inlet port, and the end of the cold water outlet conduit is received within the cold water inlet port. An outlet conduit includes an end received within the outlet port of the fluid connector. A delivery spout is positioned intermediate the hot water control valve and the cold water control valve, the outlet conduit being received within the delivery spout.

According to a further illustrative embodiment of the present disclosure, a faucet assembly includes a waterway having a conduit with an end, and a base coupled to the end of the conduit. A valve assembly is operably coupled to the base and is in fluid communication with the conduit. A valve body includes a sidewall receiving the base of the waterway and including a retaining recess. A retainer is supported by the base and is configured to be received within the retaining recess of the valve body to couple the base with the valve body.

In yet another illustrative embodiment of the present disclosure, a widespread faucet assembly includes a mounting base having a first opening and a second opening spaced apart from the first opening. The first opening and the second opening each include an alignment member, the mounting base configured to be operably coupled to a sink deck. A first mounting shank is received within the first opening and includes a cooperating member to cooperate with the alignment member of the first opening for rotationally aligning the first mounting shank within the mounting base. A second mounting shank is received within the second opening and includes a cooperating member to cooperate with the alignment member of the second opening for rotationally aligning the second mounting shank within the mounting base.

According to a further illustrative embodiment of the present disclosure, a faucet assembly includes a waterway having a conduit with an end, and a base coupled to the end of the conduit. A valve assembly is operably coupled to the base and is in fluid communication with the conduit. A valve body receives the base of the waterway, and a coupler is received within the valve body. The coupler includes a first retainer coupled to the base of the waterway, and a second retainer coupled to the valve body.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
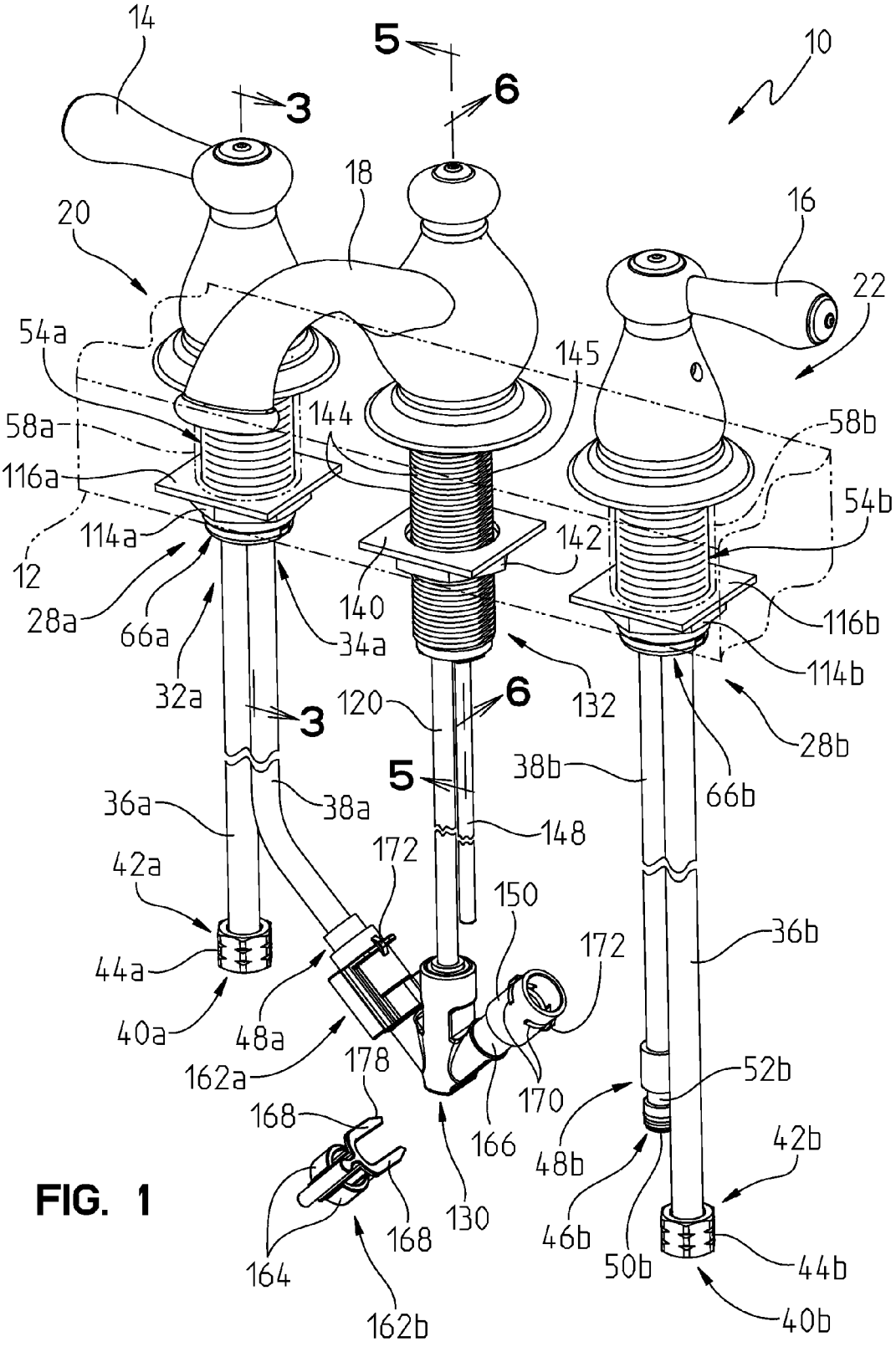
FIG. 1 is a perspective view of an illustrative widespread faucet assembly mounted to a sink deck.
Figure 2:
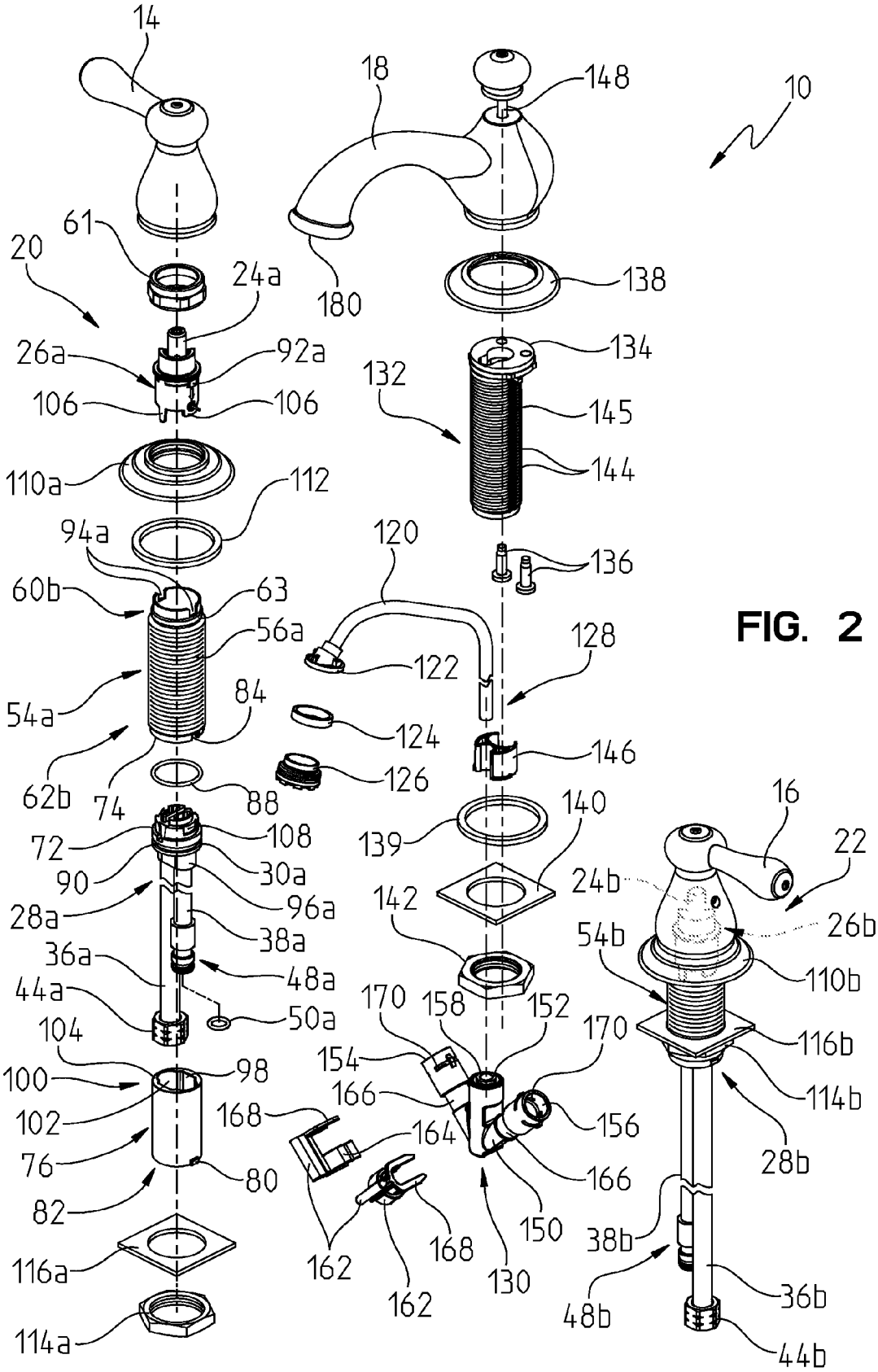
FIG. 2 is an exploded perspective view of the widespread faucet assembly of FIG. 1.

Referring initially to FIG. 1, an illustrative embodiment faucet assembly 10 is shown mounted to a sink deck 12. The faucet assembly 10 is often referred to as a widespread faucet assembly in that the hot and cold water control handles 14 and 16 are mounted in spaced relation to the delivery spout 18 with no interconnecting base or escutcheon supported above the sink deck 12. The delivery spout 18 is illustratively formed of a metal, such as plated brass. The hot and cold water control handles 14 and 16 are illustratively coupled to hot and cold water control assemblies 20 and 22, respectively. Each water control assembly 20 and 22 is substantially similar. As such, in the following description reference will be made primarily to the hot water control assembly 20, with the understanding that the cold water control assembly 22 is substantially the same, except for the relative orientation of certain components (FIGS. 1 and 2). Similar components of the hot water control assembly 20 and the cold water control assembly 22 may be identified with like reference numbers followed by the suffix "a" and "b," respectively.

Figure 3:
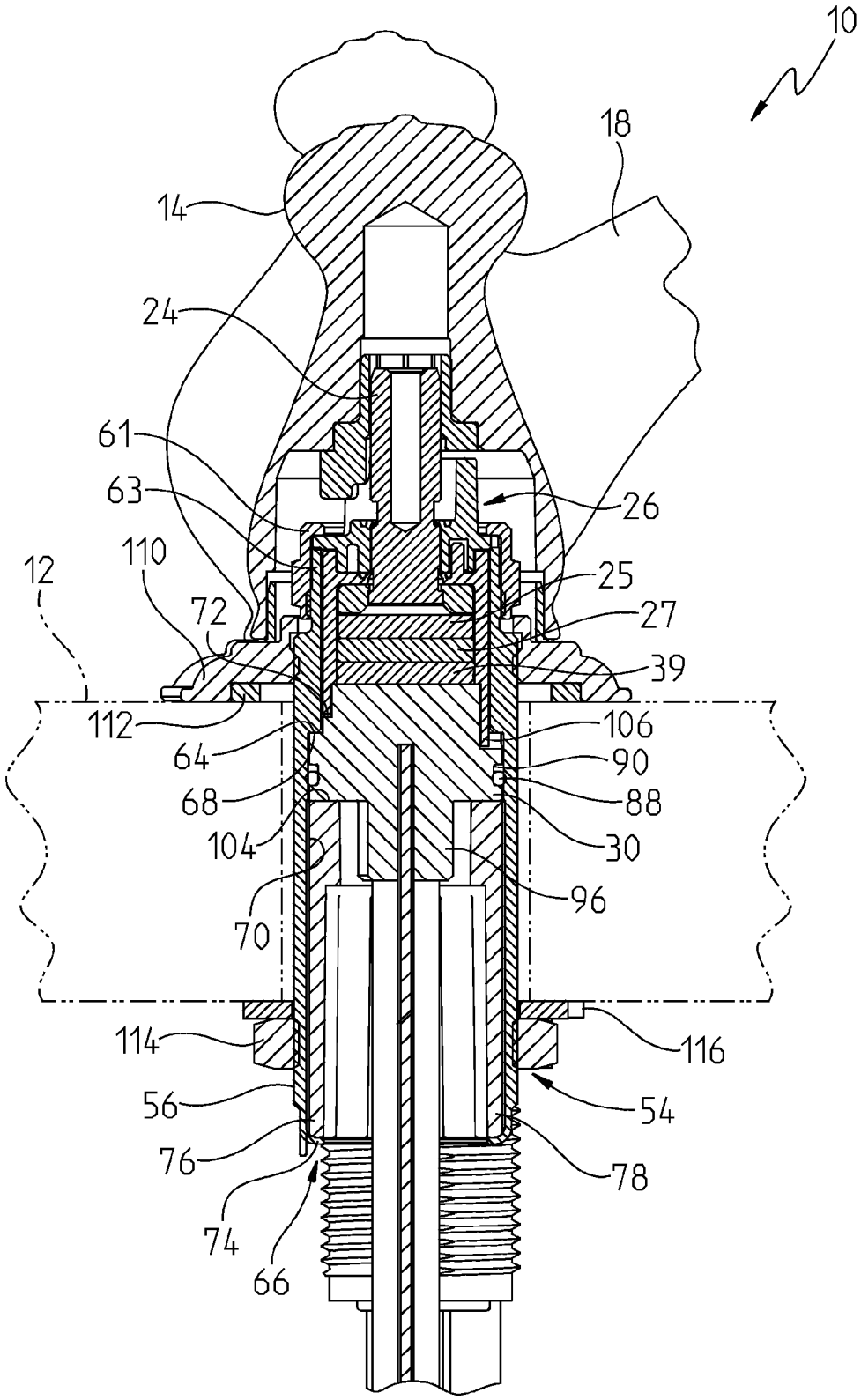
FIG. 3 is a cross-sectional view taken along line 3-3 of FIG. 1.
Figure 6:
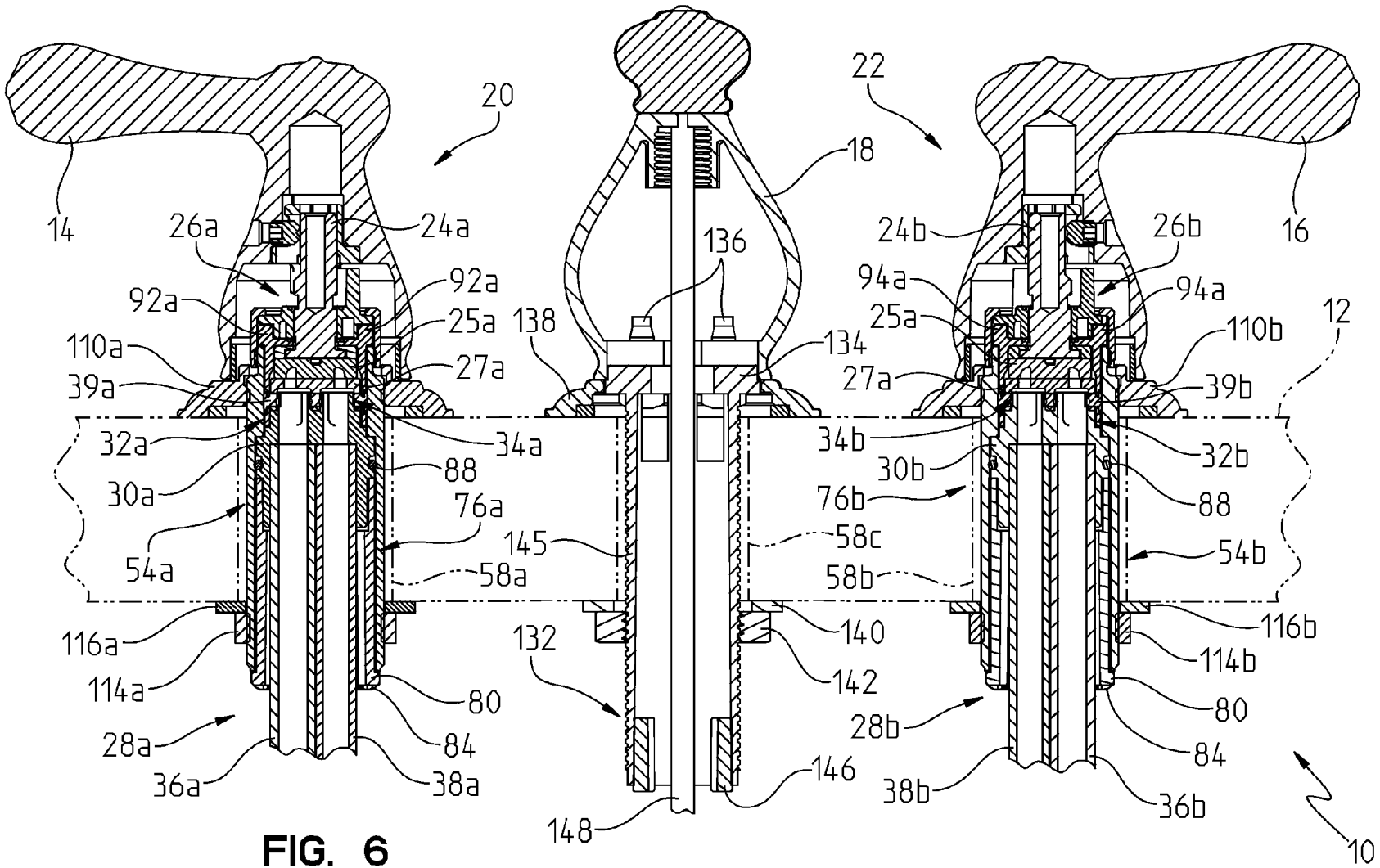
FIG. 6 is a cross-sectional view taken along line 6-6 of FIG. 1.

The water control assemblies 20 and 22 include handles 14 and 16 operably coupled to stems 24*a*, 24*b* of valve assemblies or cartridges 26*a*, 26*b*, respectively. Rotation of the handles 14 and 16 cause corresponding rotation of the valve stems 24*a*, 24*b* of the valve cartridges 26*a*, 26*b* to control the flow of hot and cold water therethrough. In one illustrative embodiment, rotation of the stem 24*a*, 24*b* causes corresponding rotation of an upper valve member 25 relative to a lower valve member 27 to control water flow from an inlet or supply conduit 36 to an outlet conduit 38 (FIGS. 3 and 6). Each valve member 25 and 27 may comprise a coated ceramic disk. The valve cartridges 26 may be of the type disclosed in further detail in U.S. Patent Application Ser. No. 61/132,664, filed Jun. 20, 2008, entitled "Valve Assembly for a Two Handle Faucet."

A waterway 28 is operably coupled to the valve cartridge 26 and illustratively includes a coupler or base 30 fluidly coupled to first ends 32 and 34 of inlet or supply tube or conduit 36 and outlet tube or conduit 38, respectively. A gasket 39 illustratively seals the valve cartridge 26 to the base 30 (FIG. 3). More particularly, the gasket 39 provides a face seal between the lower valve member 27 and the base 30. The second end 40 of the inlet conduit 36 includes an end fitting 42 including a male adapter (not shown) and a coupling nut 44. In one illustrative embodiment, the end fitting 42 may be of the type detailed in U.S. patent application Ser. No. 12/233,839, filed Sep. 19, 2008, entitled "Overmolded Fitting Connection with Color Indication." The second end 46 of the outlet conduit 38 includes a conventional fluid coupling 48 including an o-ring 50 and a connection or retaining groove 52.

In one illustrative embodiment, the base 30 of each waterway 28 is an overmold formed of a polymer. More particularly, the base 30 may be overmolded about the first ends 32 and 34 of the supply conduit 36 and the outlet conduit 38. In a further illustrative embodiment, the supply conduit 36 and the outlet conduit 38 are formed of a polymer. Illustratively, both the base 30 and the conduits 36 and 38 may be formed of a polyethylene which are cross-linked after the overmolding process, thereby forming a cross-linked polyethylene (PEX). Additional details of such an illustrative process are disclosed in U.S. patent application Ser. No. 11/700,634, filed Jan. 31, 2007, entitled "Faucet including a Molded Waterway Assembly."

As further detailed herein, each base 30 is illustratively formed of a flowable material overmolded around ends 32 and 34 of respective supply conduits 36, 38. While any suitable material may be used to form base 30, a polymer, including thermoplastics and thermosets, may be utilized in the illustrative embodiment. In one illustrative embodiment, each base 30 is formed of a polyethylene which has been overmolded around the ends 32, 34 of respective conduits 36, 38 and subsequently cross-linked to form PEX. In certain illustrative embodiments, reinforcing members, such as glass fibers, may be provided within the polyethylene of each base 30.

A valve body or mounting shank 54 includes a cylindrical sidewall 56 and is supported within a mounting opening 58 of the sink deck 12. While the valve body 54 is illustratively formed of a metal, such as brass, other suitable materials may be substituted therefor. The valve body 54 receives the base 30 of the waterway 28 and the valve cartridge 26 is operably coupled to an upper end 60 of the valve body 54. More particularly, a bonnet nut 61, illustratively formed or brass, threadably engages external threads 63 formed at the upper end 60 of the valve body 54. The inlet and outlet conduits 36 and 38 extend through a lower end 62 of the valve body 54.

Figure 4:
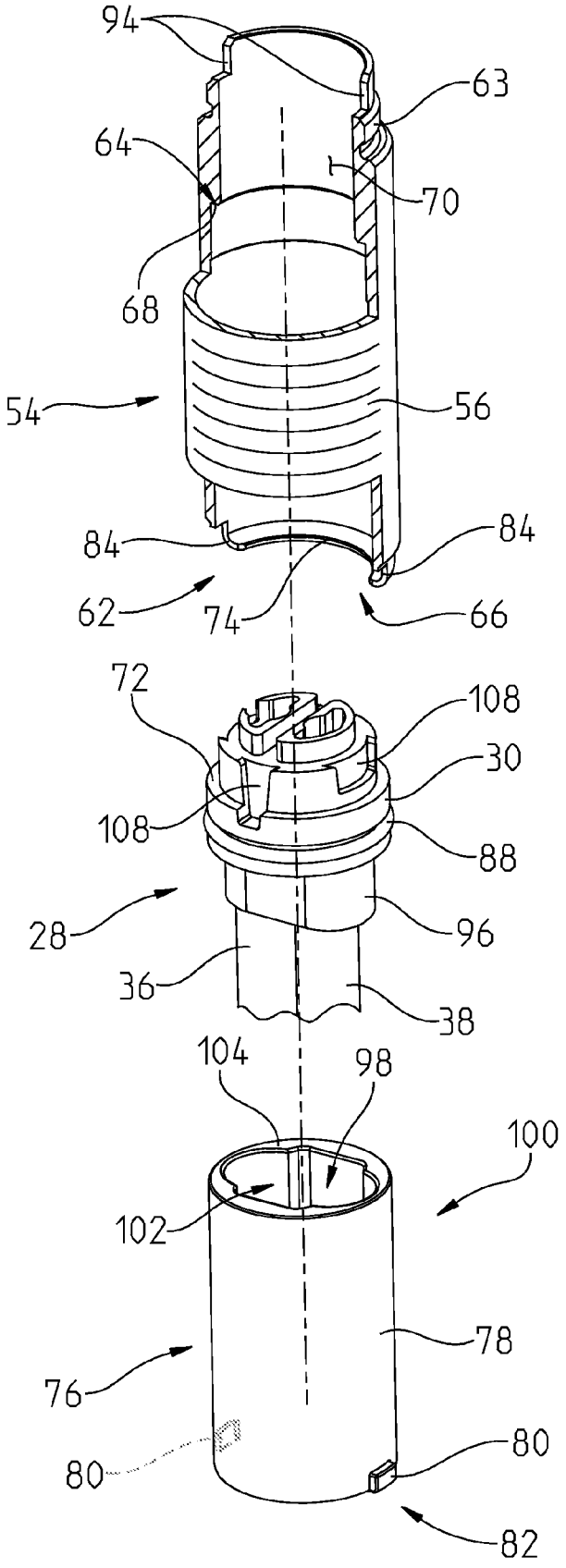
FIG. 4 is an exploded perspective view, in partial cross-section, of the illustrative valve body, waterway, and spacer of the faucet assembly of FIG. 1.

With reference to FIGS. 3 and 4, a first retainer 64 is integral with the sidewall 56 of the valve body 54 and is configured to prevent movement of the base 30 of the waterway 28 toward the upper end 60 of the valve body 54. A second retainer 66 is integral with the sidewall 56 of the valve body 54 and is configured to prevent movement of the base 30 of the waterway 28 toward the lower end 62 of the valve body 54.

In the illustrative embodiment, the first retainer 64 comprises a radially extending flange or annular lip 68 extending radially inwardly from the inner surface 70 of the sidewall 56 of the valve body 54. The flange 68 engages an annular upper surface 72 of the base 30. The second retainer 66 is illustratively formed by bending radially inwardly the lower edge 74 of the sidewall 56 of the valve body 54. Illustratively, a spacer 76 extends between the second retainer 66 and the base 30. The spacer 76 illustratively is formed of an acetal copolymer, such as Celcon® M90™ available from Ticona of Florence, Ky. The spacer 76 includes a substantially cylindrical sidewall 78 coaxially received within the sidewall 56 of the valve body 54. Diametrically opposed alignment tabs 80 extend radially outwardly from the lower end 82 of the spacer 76 and are configured to be received within cooperating notches 84 within the valve body 54 for proper rotational alignment therebetween.

During assembly, the base 30 is first inserted from the lower end 62 of the valve body 54, followed by the spacer 76 until it meets the base 30 of the waterway 28. Standing edge 74 of brass from the valve body 54 is then bent or rolled over in a metal forming operation to trap the spacer 76 and to apply an upward load to the base 30 via the spacer 76, thereby retaining the base 30 and the spacer 76 between the retainers 64 and 66. While the illustrative figures show a pair of circumferentially spaced apart edges 74 rolled radially inwardly, it should be appreciated that any suitable number of spaced apart edges or tabs may be used to restrain the spacer 76.

As shown in FIGS. 2-4, an o-ring 88 extends within a peripheral channel 90 of the base 30 of the waterway 28. The o-ring 88 is configured to provide a secondary and radial seal between the sidewall 56 of body 54 and the base 30 for preventing water that could possibly leak past the cartridge 26*a*, or drip off a user's hands, from getting below the sink deck 12.

The spacer 76 cooperates with the waterway 28 to facilitate proper rotational alignment or orientation of the waterway 28 in the valve body 54 and, as such, facilitating proper alignment or orientation of the valve cartridge 26*a* to the body 54. More particularly, the base 30 of the waterway 28 should be properly aligned with the valve body 54 such that the mating valve cartridge 26*a* is properly aligned with the valve body 54. The valve cartridge 26*a* includes diametrically opposed alignment tabs or keys 92 which are received within cooperating recesses or notches 94 formed at the upper end 60 of the valve body 54, such that the handle 14 is properly aligned for use. In the illustrative embodiment, an oval shaped protrusion or projection 96 extends downwardly from the base 30 of the waterway 28 to engage in a modified oval shaped recess 98 formed in an upper end 100 of the spacer 76. A center portion 102 of the oval recess 98 is further extended generally radially outwardly to allow the water connection nut 44 to pass through the spacer 76 while allowing adequate support for the base 30 on the support surface 104 of end of the spacer 76. As such, the base 30 of the waterway 28 is keyed to the spacer 76 and, subsequently to the valve body 54.

As noted above, tabs 80 on the spacer 76 engage with notches 84 within the body 54 to rotationally restrain the spacer 76 to the body 54 which, in turn, keys the base 30 to the valve body 54. Misalignment between the base 30 and the valve cartridge 26*a* is illustratively centered using ramped tabs 106 on the cartridge 26*a* engaging with tapered slots 108 on the base 30.

With reference to FIGS. 2, 3, and 6, the water control assembly 20 is mounted to the sink deck 12 using a conventional flange or escutcheon 110, gasket 112, and mounting nut 114. The escutcheon 110 is threadably received on the upper end 60 of valve body 54, while the mounting nut 114 is threadably received on the threaded lower end 62 of the valve body 54. A washer 116 may be positioned intermediate the nut 114 and the sink deck 12.

Figure 5:
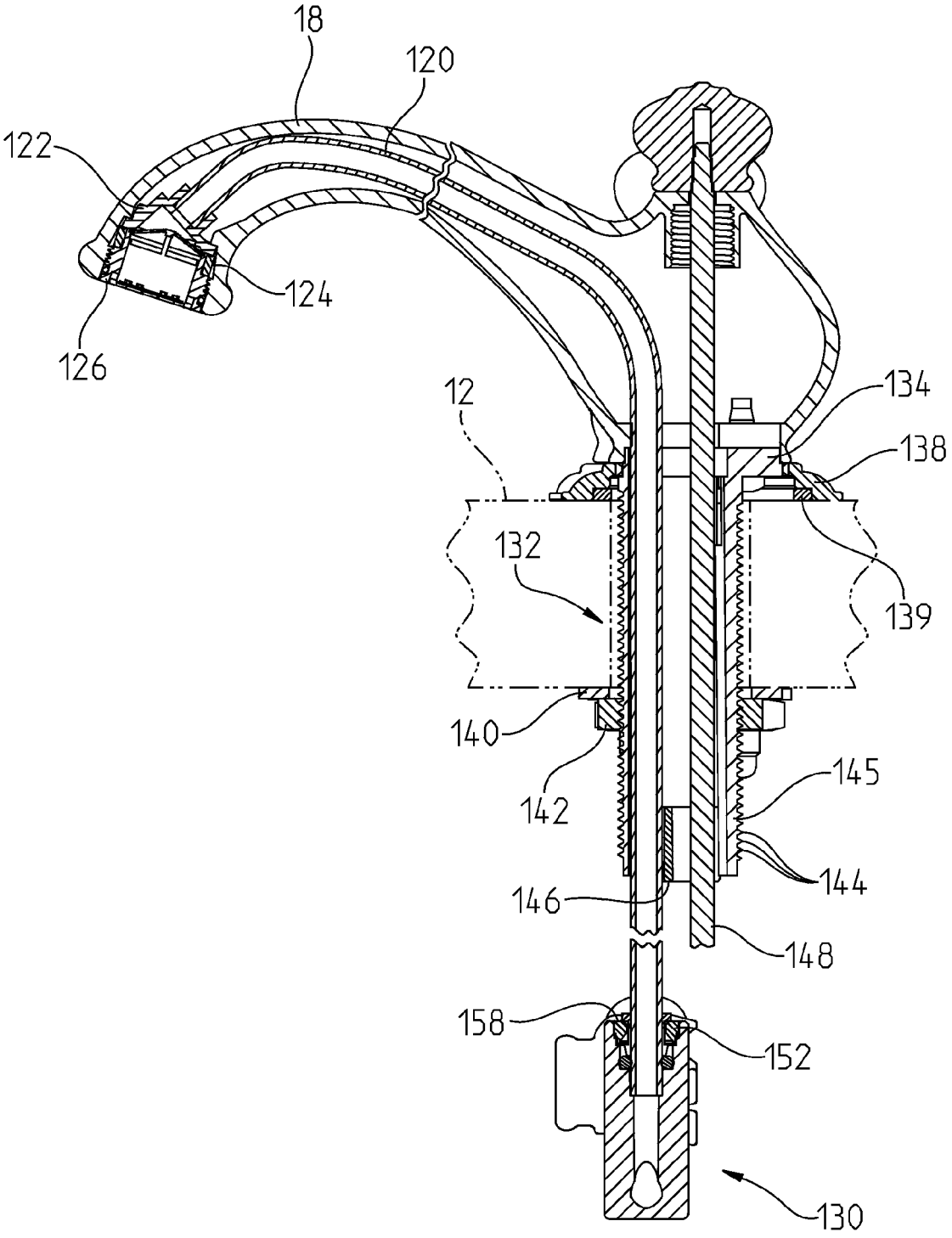
FIG. 5 is a cross-sectional view taken along line 5-5 of FIG. 1.

Referring now to FIGS. 2, 5, and 6, the delivery spout 18 illustratively includes a liner or outlet conduit 120 received therewithin. The outlet conduit 120 includes an adapter or flange 122, illustratively overmolded at an outlet end of the conduit 120. A gasket 124 provides for a seal between the flange 122 and an aerator 126. As such, water does not contact the metal portion of the delivery spout 18. Illustratively, the outlet conduit 120 and the flange 122 are formed of a polymer, such as polyethylene which is cross-linked to form PEX subsequent to the overmolding process. The inlet end 128 of the outlet conduit 120 is in fluid communication with the hot and cold water supply conduits 38*a* and 38*b* through a connector 130.

A mounting member or shank 132 includes a flange 134 for mounting to the spout 18 through the use of fasteners 136, such as screws, while retaining a finish flange or escutcheon 138. A gasket 139 may provide a seal between the escutcheon 138 and the sink deck 12. The shank 132 is illustratively made from metal in order to prevent creep and loosening on the sink deck 12. The spout 18 is illustratively secured to the sink deck 12 through the use of a washer 140 and a nut 142 threadably engaging external threads 144 on a downwardly extending tubular portion 145 of the mounting shank 132 passing through mounting opening 58*c* formed in the deck 12. A spacer 146 is positioned within the tubular portion 145 and is configured to position the outlet conduit 120 relative to a lift rod 148, which is operably coupled to a conventional pop-up drain assembly (not shown). The spacer 146 may be formed of an acetal copolymer, for example Celcon® M90™.

Figure 7:
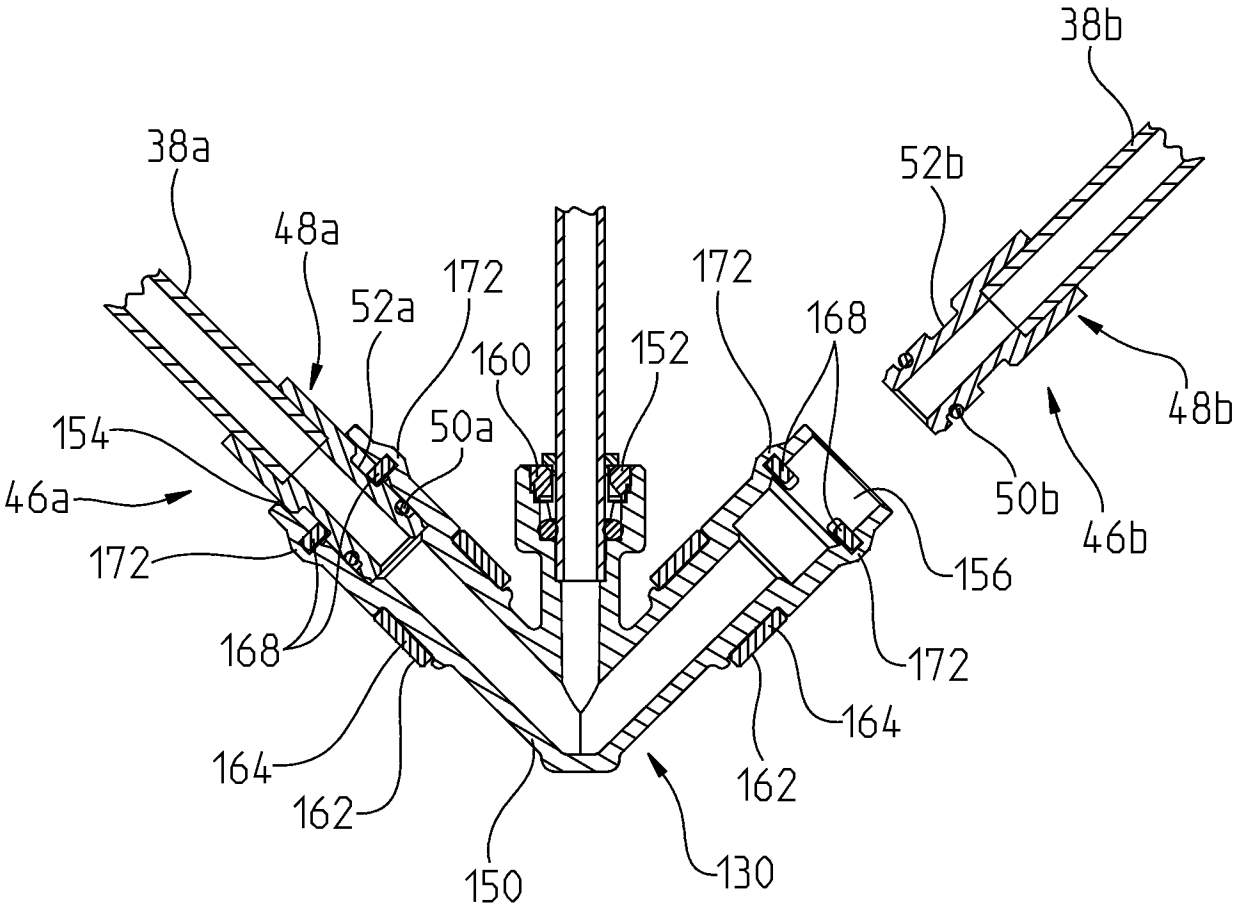
FIG. 7 is a cross-sectional view of the illustrative connector of FIG. 1.

With reference to FIGS. 1, 2, and 7, the water control assemblies 20 and 22 and the delivery spout 18 are configured to mount to variable sink deck 12 thicknesses, illustratively up to 2½ inches, while the handles 14 and 16 are configured to be spaced apart from each other anywhere from approximately 5-16 inches. The connector 130 facilitates such spacing and illustratively concludes a body 150 molded from a polymer and including a quick connect fitting 152, such as the Speedfit® fitting available from John Guest International Ltd. of Middlesex, England. More particularly, the connector body 150 includes a hot water inlet port 154, a cold water inlet port 156, and an outlet port 158. The fitting 152 is received within the outlet port 158 and illustratively includes a plurality of inwardly extending stainless steel fingers 160 which are configured to sealingly engage and trap the end of the outlet conduit 120 therewithin (FIG. 7).

Retainers or clips 162 are utilized to maintain the connection between the ends 46 of the conduits 38 and the body 150. More particularly, the clips 162 secure the fluid coupling 48*a* and 48*b* of the conduits 38*a* and 38*b* within the respective inlet ports 154 and 156. Each of the inlet ports 154 and 156 is positioned on opposite sides of the outlet port 158 and is angled thereto to facilitate installation and positioning of the water control assemblies 20 and 22.

The clips 162 are illustratively formed of a polymer and grip around the body 150. More particularly, each retainer 162 includes retaining legs 164 to clip the retainer 162 to a retaining groove 166 formed in the body 150. Retention legs 168 engage within slots 170 formed in the connector body 150. Retaining walls or tabs 172 on the body 150 keep the retention legs 168 radially engaged within the slots 170 and within the outlet connection or retaining groove 52 formed in the fluid coupling 48 at the end 46 of the outlet conduit 38. A tapered end 178 on the legs 168 allows for an easier lead in to the slots 170 (FIG. 1). This will connect the inlet tubes 38*a* and 38*b* from the hot and cold water control assemblies 20 and 22 to the spout outlet conduit 120, thereby allowing for water flow to the aerator 126 positioned at the spout outlet 180.

Figure 8:
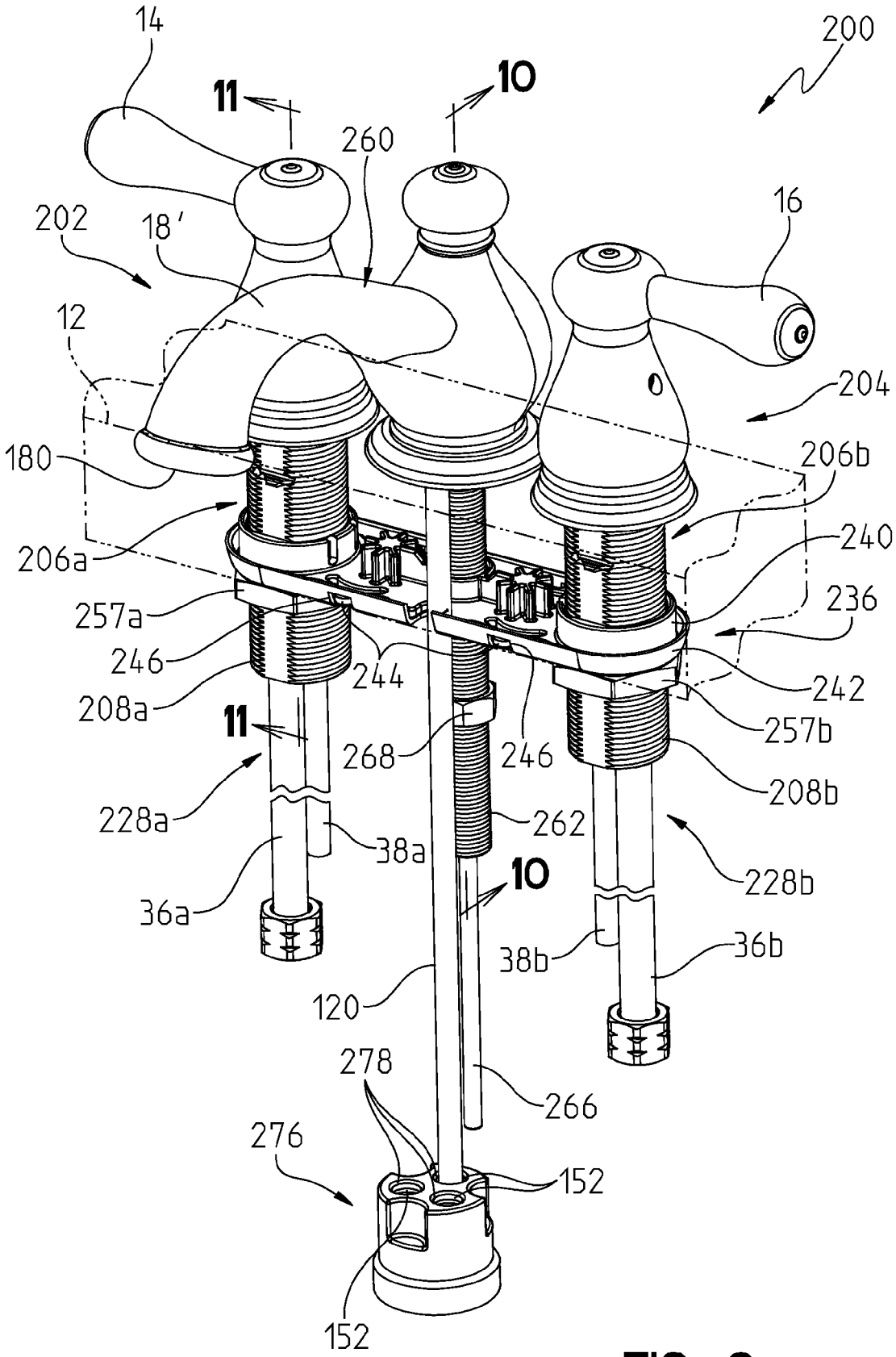
FIG. 8 is a perspective view of a further illustrative widespread faucet assembly mounted to a sink deck.
Figure 9:
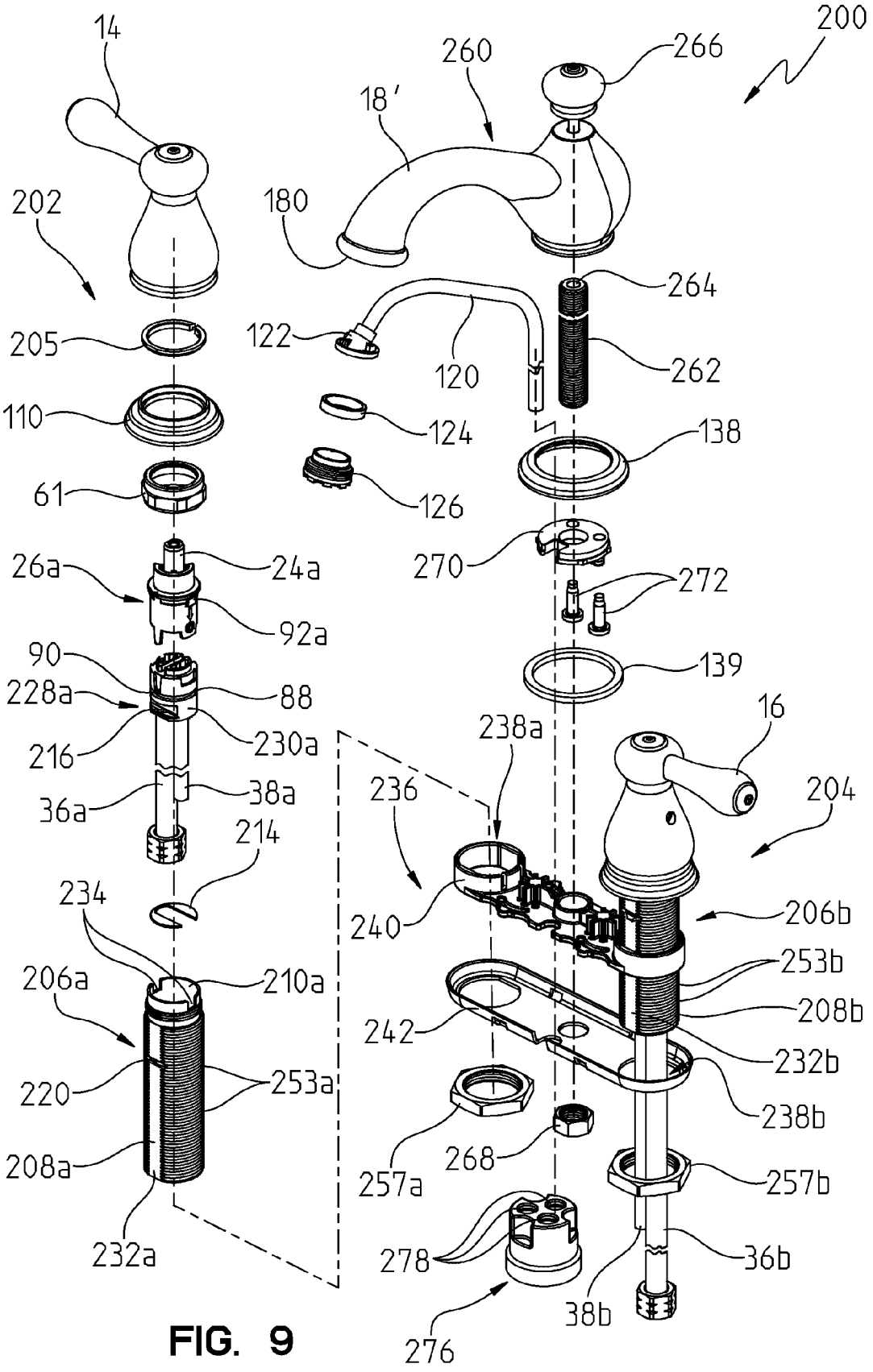
FIG. 9 is an exploded perspective view of the widespread faucet assembly of FIG. 8.

With reference now to FIGS. 8-13, a further illustrative embodiment faucet assembly 200 is shown. The faucet assembly 200 as shown in FIGS. 8 and 9 is often referred to as a mini-widespread faucet in that the hot and cold water control assemblies 202 and 204 are positioned closer to each other than the hot and cold water control assemblies 20 and 22 of the widespread faucet assembly 10 of FIG. 1. More particularly, the water control assemblies 202 and 204 of faucet assembly 200 are illustratively spaced apart on centerlines of about 4 inches, while the water control assemblies 20 and 22 of faucet assembly 10 are illustratively spaced apart on centerlines of at least about 6 inches. In the following description of the faucet assembly 200 of FIGS. 8-13, components similar to those identified with respect to the faucet assembly 10 of FIGS. 1-7 will be identified with like reference numbers.

Figure 10:
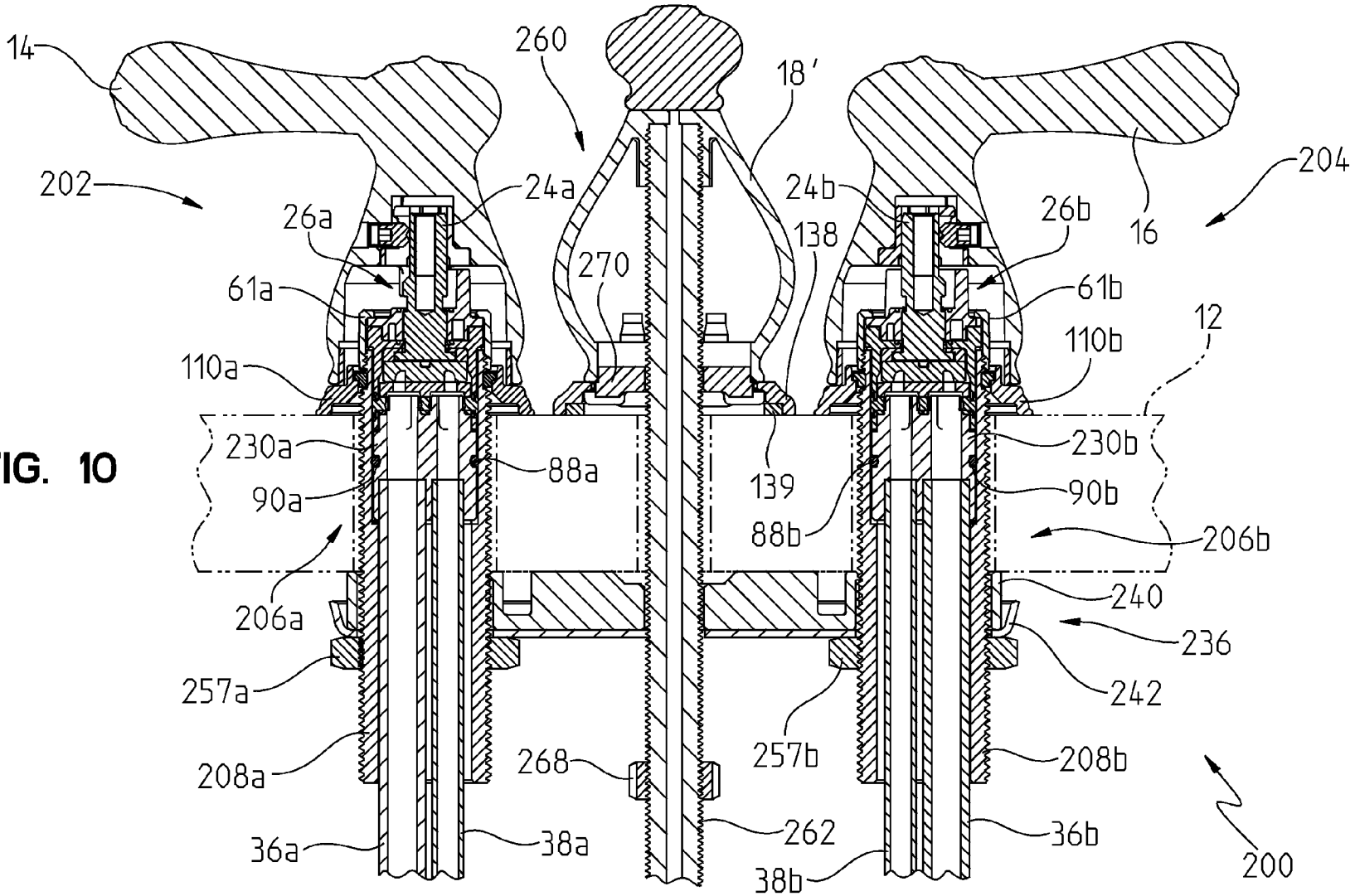
FIG. 10 is a cross-sectional view taken along line 10-10 of FIG. 8.

With reference to the illustrative embodiment of FIGS. 8-10, the hot and cold water control handles 14 and 16 are illustratively coupled to the hot and cold water control assemblies 202 and 204, respectively. Each water control assembly 202 and 204 is substantially identical. As such, in the following description reference will be made primarily to the hot water control assembly 202, with the understanding that the cold water control assembly 204 is substantially the same except for the relative orientation of certain components (FIGS. 8-10). Similar components of the hot water control assembly 202 and the cold water control assembly 204 may be identified with like reference numbers followed by the suffix "a" and "b", respectively.

Similar to the faucet assembly 10, in the faucet assembly 200 each control assembly 202 and 204 includes a waterway 228 fluidly coupled to a valve cartridge 26. As detailed above, the base 230 of each waterway 228 may comprise a polymer overmolded around the ends 32 and 34 of the supply conduit 36 and the outlet conduit 38.

Figure 11:
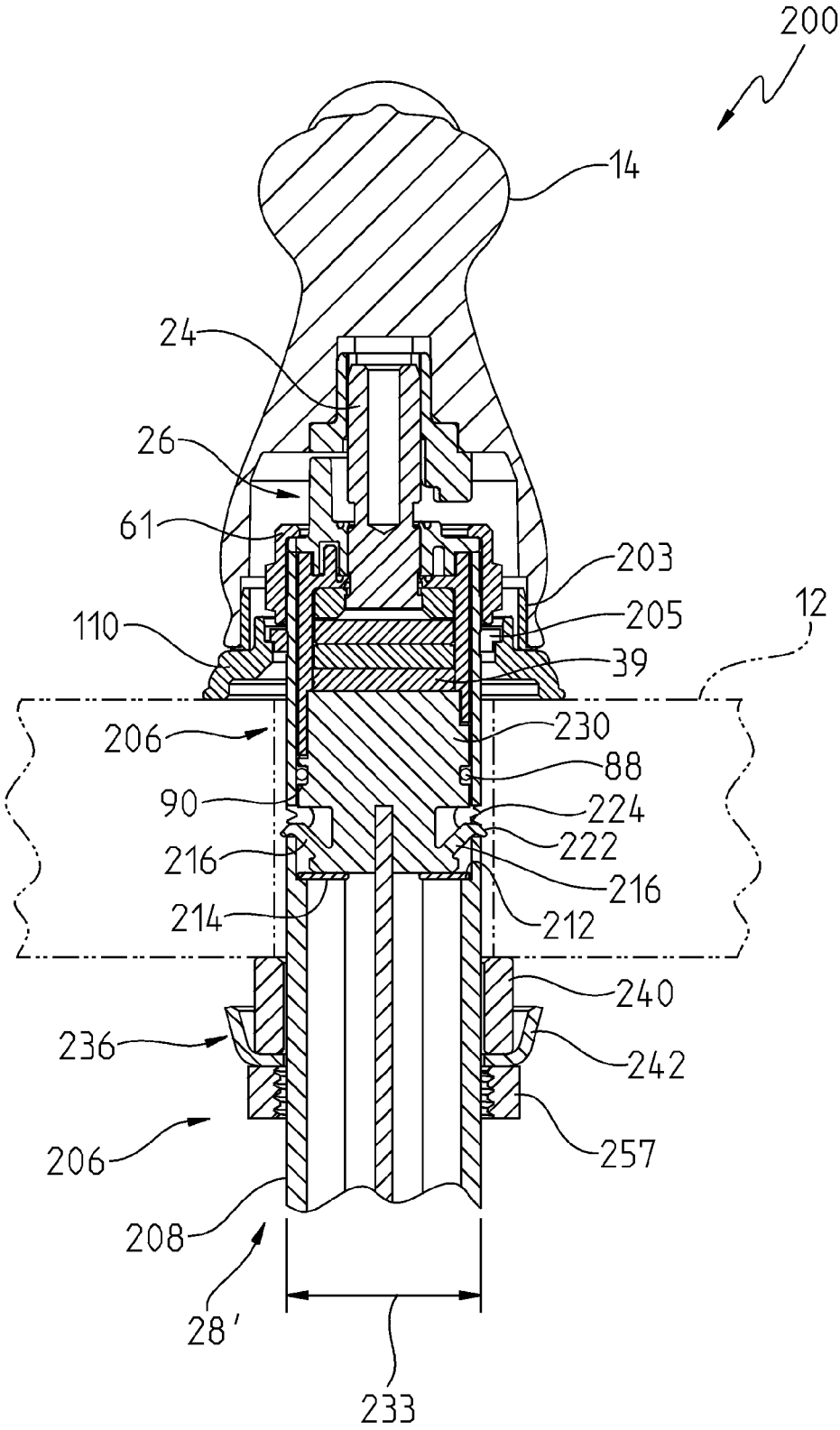
FIG. 11 is a cross-sectional view taken along line 11-11 of FIG. 8.
Figure 13:
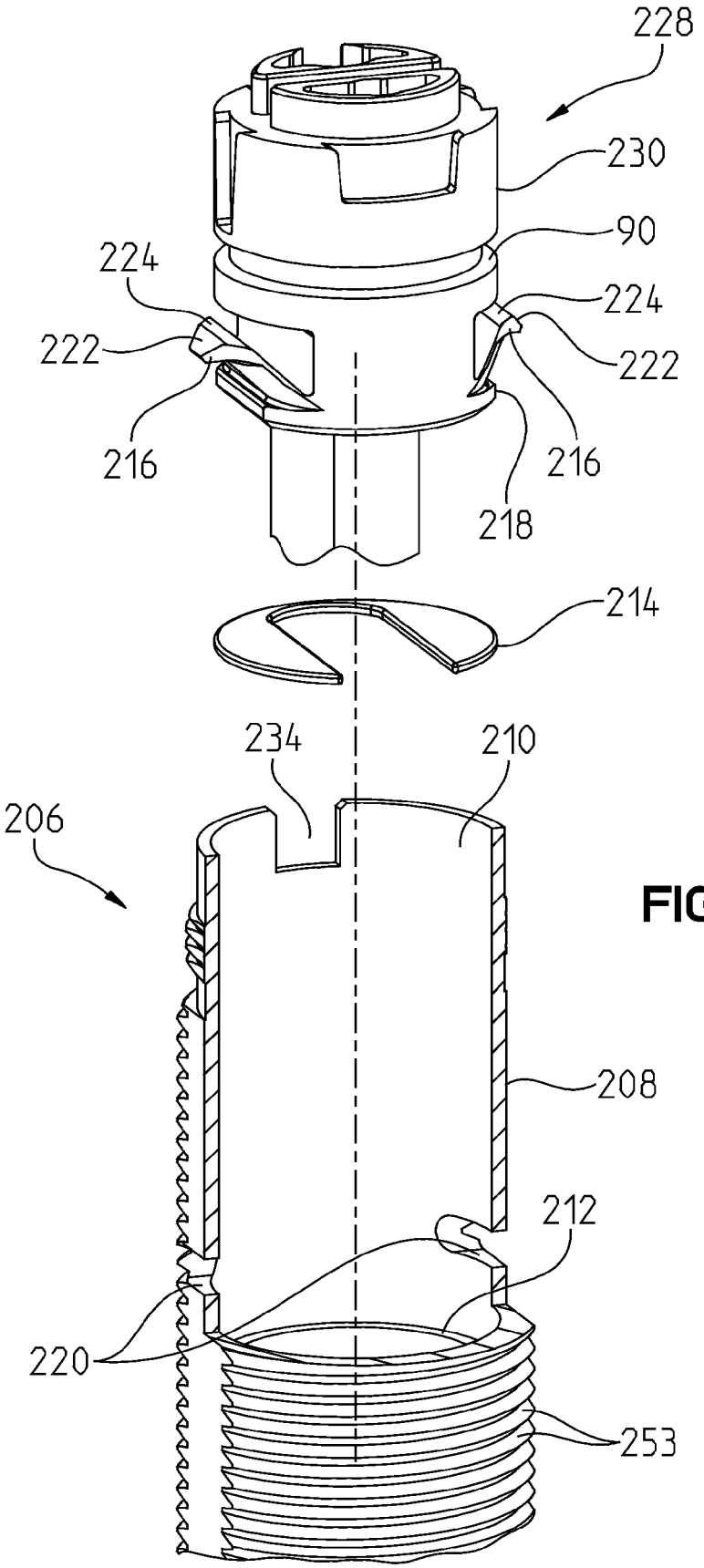
FIG. 13 is an exploded perspective view, in partial cross-section, of the illustrative valve body and waterway of the faucet assembly of FIG. 8.

Each valve body or mounting shank 206 includes a substantially cylindrical sidewall 208. Illustratively, the valve body 206 is formed of metal, such as brass. The valve body 206 has a bore 210 machined from the top thereby leaving a ledge or annular lip 212 for supporting the waterway base 230 of the waterway assembly 228 (FIGS. 11 and 13). A spacer or support washer 214 may be provided to increase the contact support between the base 230 and the valve body 206.

A pair of diametrically opposed retainers 216 are illustratively integrally formed within an outer portion 218 of the base 230 and are configured to snap into slots 220 machined into the sidewall 208 (FIG. 13). As such, engagement between the retainers 216 and the slots 220 align and rotationally restrain the base 230 of the waterway 228. The retainers 216 are illustratively biased generally radially outwardly from base 230, and retainer 216 may include an angled or inclined surface 222 to facilitate insertion into the slots 220 and a retaining ledge or lip 224 to prevent removal therefrom. Such engagement will keep the base 230 from being pushed out of the body 206 if the valve cartridge 26 is removed for service and the conduits 36, 38 are coiled and pushed upward after being installed.

The valve bodies 206 may be mounted using mounting nuts 257, illustratively formed of brass. Illustratively, the cartridge 26 is held in place through a bonnet nut 61. O-ring 88 is received within peripheral channel 90 of the base 230 and provides a secondary radial seal to keep water from leaking under the sink deck 12.

Figure 12:
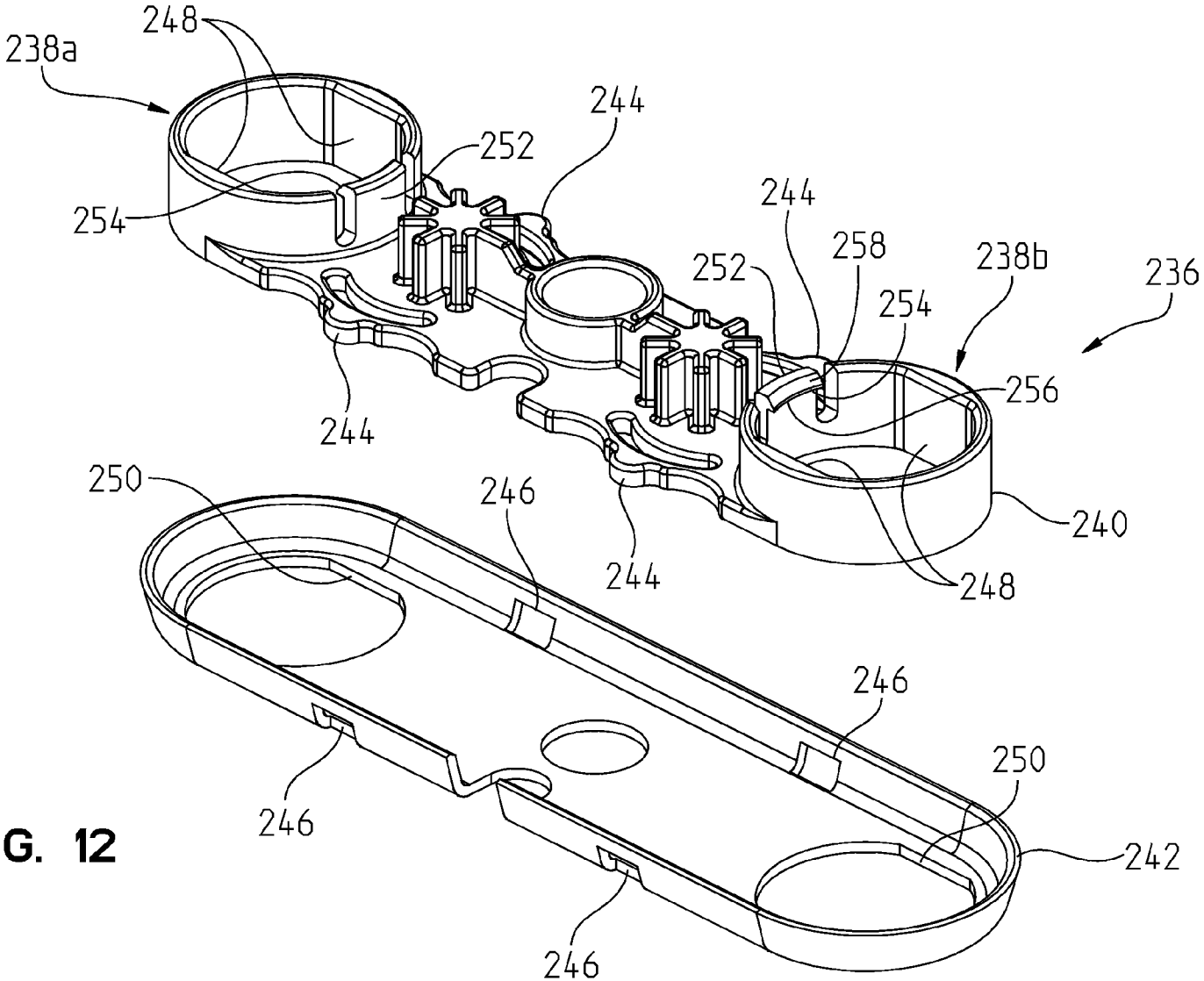
FIG. 12 is a detail exploded perspective view of the mounting base of the faucet assembly of FIG. 8.

The sidewalls 208 of valve bodies 206 illustratively include flats 232 to define a minor diameter or transverse dimension 233 (FIG. 11). The flats 232 are oriented about 90 degrees relative to respective notches 234 formed in the top end of the valve body 206 which engage with the alignment tabs 92 of the valve cartridge 26. A mounting base 236 includes a pair of spaced apart mounting openings 238*a* and 238*b* to receive the control assemblies 202 and 204 and the valve bodies 206*a* and 206*b*. The mounting base 236 includes a support member 240 coupled to a bracket 242. The support member 240 may be formed of a polymer while the bracket 242 may be formed of a metal, such as steel. A plurality of retaining members 244 of the support member 240 are received within openings 246 in the bracket 242, thereby securing the support member 240 to the bracket 242 (FIG. 12).

Flats 248 and 250 within the openings 238 defined by the support member 240 and the bracket 242 engage with the flats 232 on the respective sidewalls 208*a*, 208*b* to align the valve body 206*a*, 206*b* so the handles 14 and 16 will be oriented correctly above the sink deck 12, and to provide additional torsional resistance for the valve body 206*a*, 206*b* when torque is supplied to the handles 14 and 16. Flexible retainers 252 are supported by the support member 240 of the mounting base 236 and engage with the external threads 253 of the respective shank 208*a*, 208*b*. The retainers 252 include lips 254 having a helical edge surface 256 to mate with the valley portion (minor diameter) of threads 253 of the shank 208*a*, 208*b*. An inclined surface 258 on lips 254 permits upward movement of the retainer 252 relative to the threads. After the shanks 208*a*, 208*b* are drawn through the holes in the sink deck 12, the mounting base 236 is aligned and pushed up from below onto the shanks 208*a*, 208*b* below the surface of the sink deck 12. The retainers 252 engage with the threads 253, thereby allowing the mounting base 236 to stay in position as desired. A mounting nut 257 is then threaded up to the shank 208*a*, 208*b* against the lower surface of the bracket 242 thereby mounting the valve bodies 206*a*, 206*b* in place.

A delivery spout assembly 260 illustratively includes a small diameter threaded shank 262 (illustratively a ½-18 threaded tube) with an opening 264 extending therethrough. The opening 264 is configured to slidably receive a lift rod 266 for a pop-up drain assembly (not shown). The spout assembly 260 may be mounted using a brass nut 268 threadably received on the shank 262 and engaging the lower surface of the bracket 242 of the mounting base 236. A mounting member 270 is illustratively coupled to the spout assembly 260 through fasteners, such as bolts 272, and guides the outlet conduit 120 relative to the lift rod 266. The outlet conduit 120 is received within the delivery spout 18' in a manner similar to that detailed above.

A fluid connector or manifold 276 fluidly couples ends of the conduits 38*a*, 38*b*, and 120. Illustratively, the manifold 276 includes receiving bores 278 each having a quick connect fitting 152, such as the Speedfit® fitting detailed above.

Figure 14:
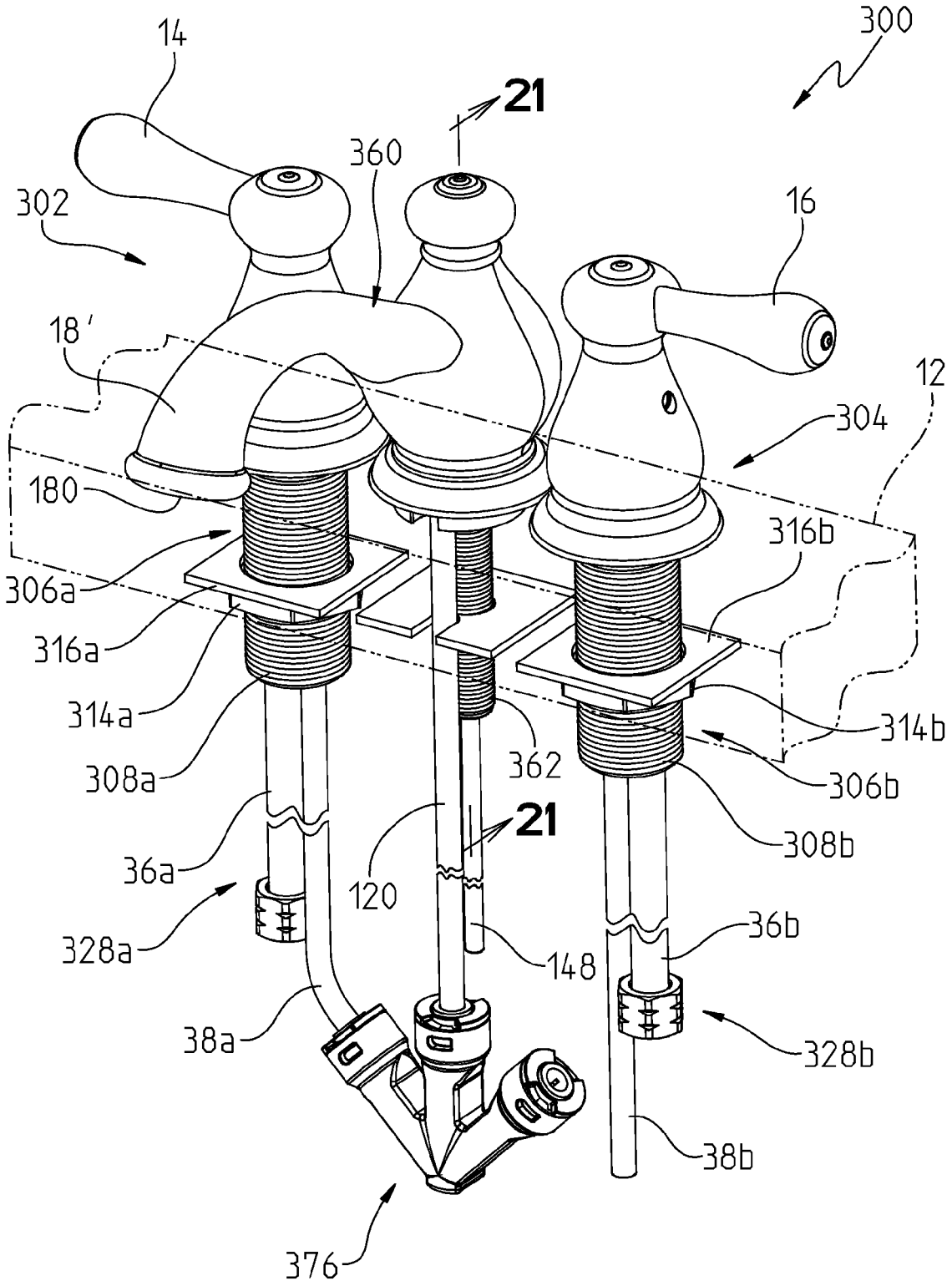
FIG. 14 is a perspective view of another illustrative widespread faucet assembly mounted to a sink deck.
Figure 15:
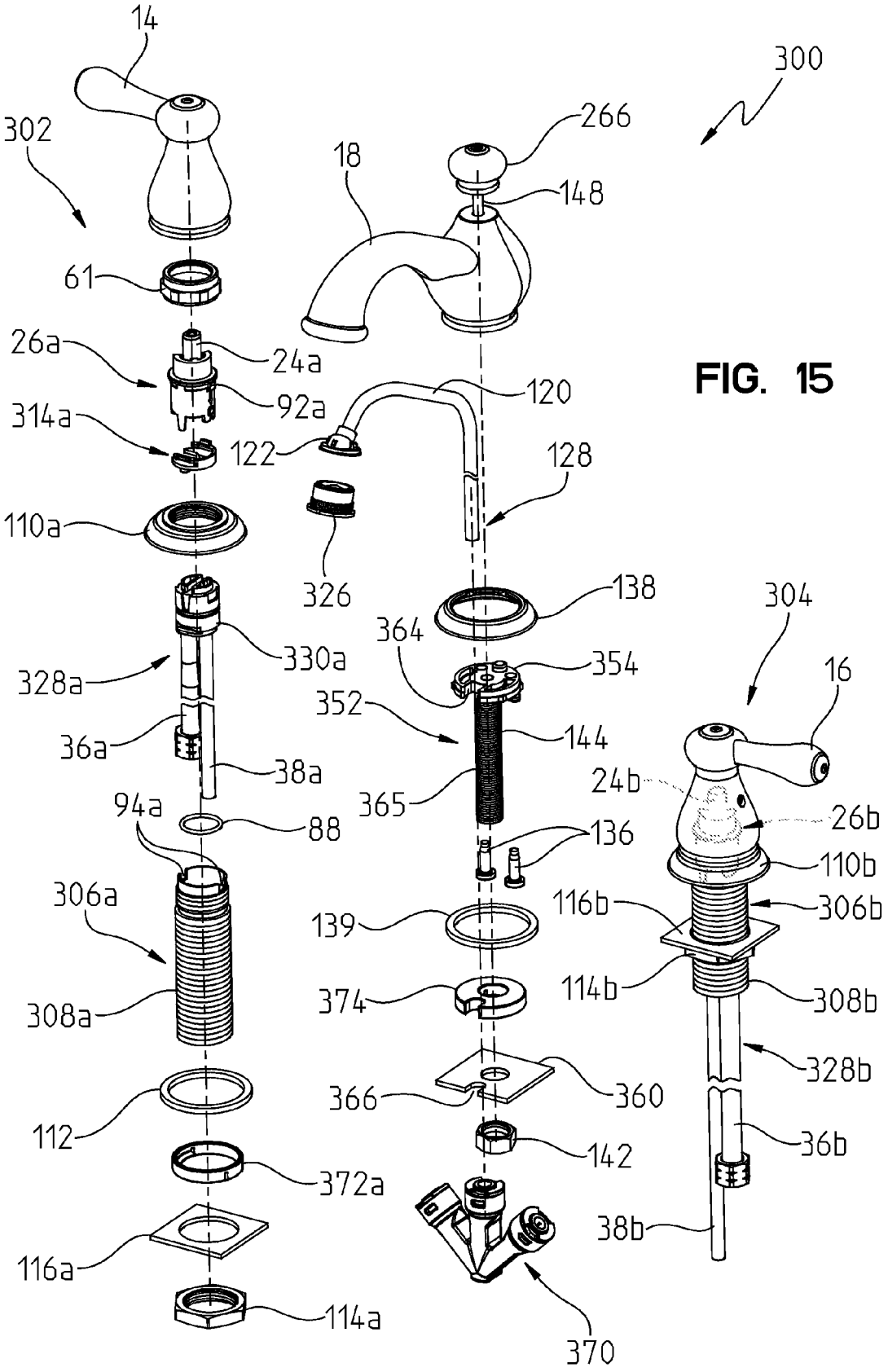
FIG. 15 is an exploded perspective view of the widespread faucet assembly of FIG. 14.

With reference now to FIGS. 14 and 15, a further illustrative embodiment faucet assembly 300 is shown. The faucet assembly 300 includes many similar components to those detailed above in the widespread faucet assembly 10 of FIG.

1 and the mini-widespread faucet assembly 200 of FIG. 8. In the following description of the faucet assembly 300 of FIGS. 14-21, components similar to those identified with respect to the faucet assembly 10 of FIG. 1 and faucet assembly 200 of FIG. 8 will be identified with like reference numbers.

Figure 21:
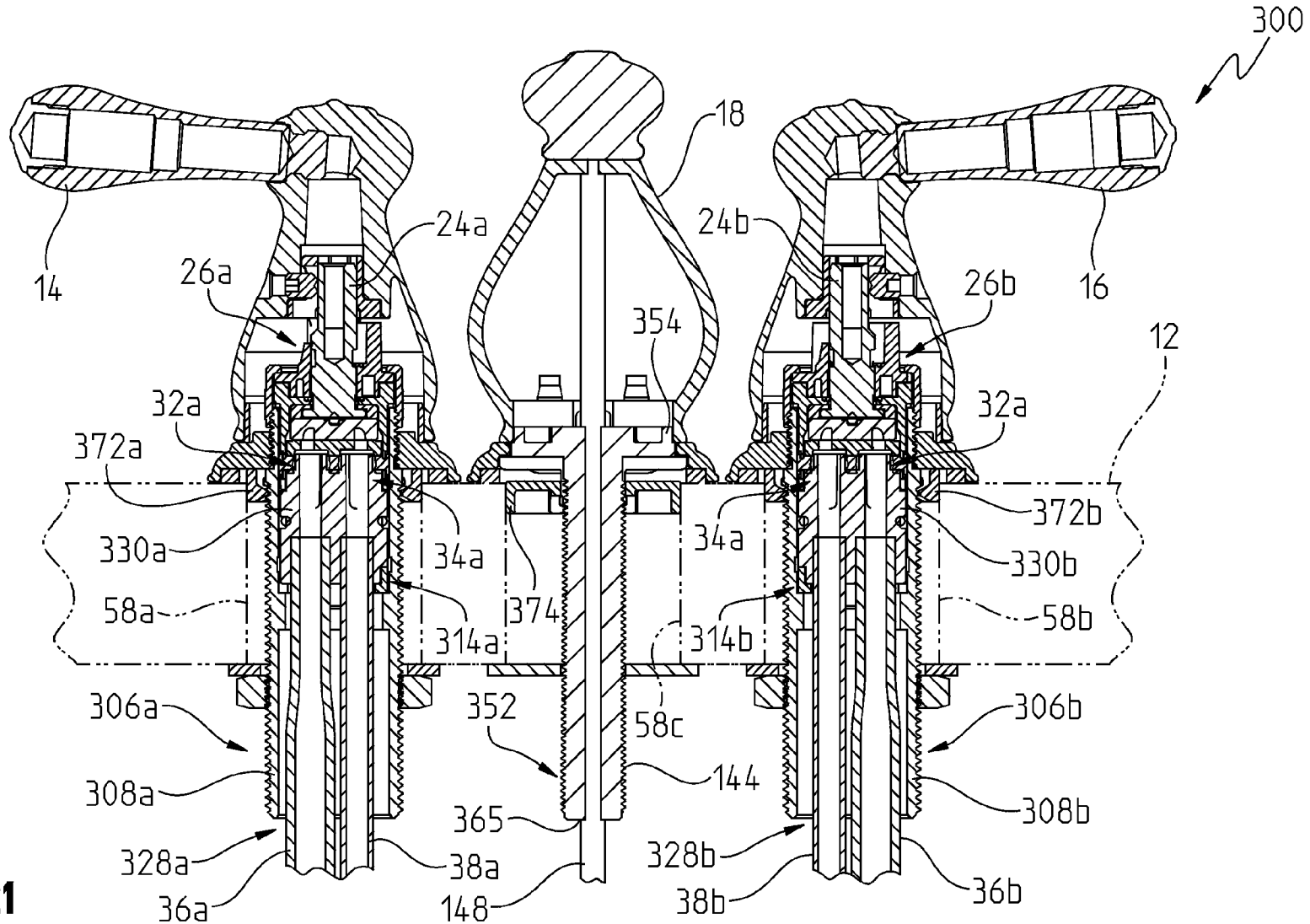
FIG. 21 is a cross-sectional view taken along line 21-21 of FIG. 14.

In the illustrative embodiment of FIGS. 14, 15, and 21, the hot and cold water control handles 14 and 16 are illustratively coupled to hot and cold water control assemblies 302 and 304, respectively. Each water control assembly 302 and 304 is substantially identical. As such, in the following description reference will be made primarily to the hot water control assembly 302, with the understanding that the cold water control assembly 304 is substantially the same, except for the relative orientation of certain components (FIGS. 14, 15, and 21). Similar components of the hot water control assembly 302 and the cold water control assembly 304 may be identified with like reference numbers followed by the suffix "a" and "b", respectively.

Similar to the faucet assemblies 10 and 200, in the faucet assembly 300 each control assembly 302 and 304 includes a waterway 328 fluidly coupled to a valve cartridge 26. As detailed above, the base 330 of each waterway 328 may be overmolded around the ends 32 and 34 of the supply conduit 36 and the outlet conduit 38.

Figure 16:
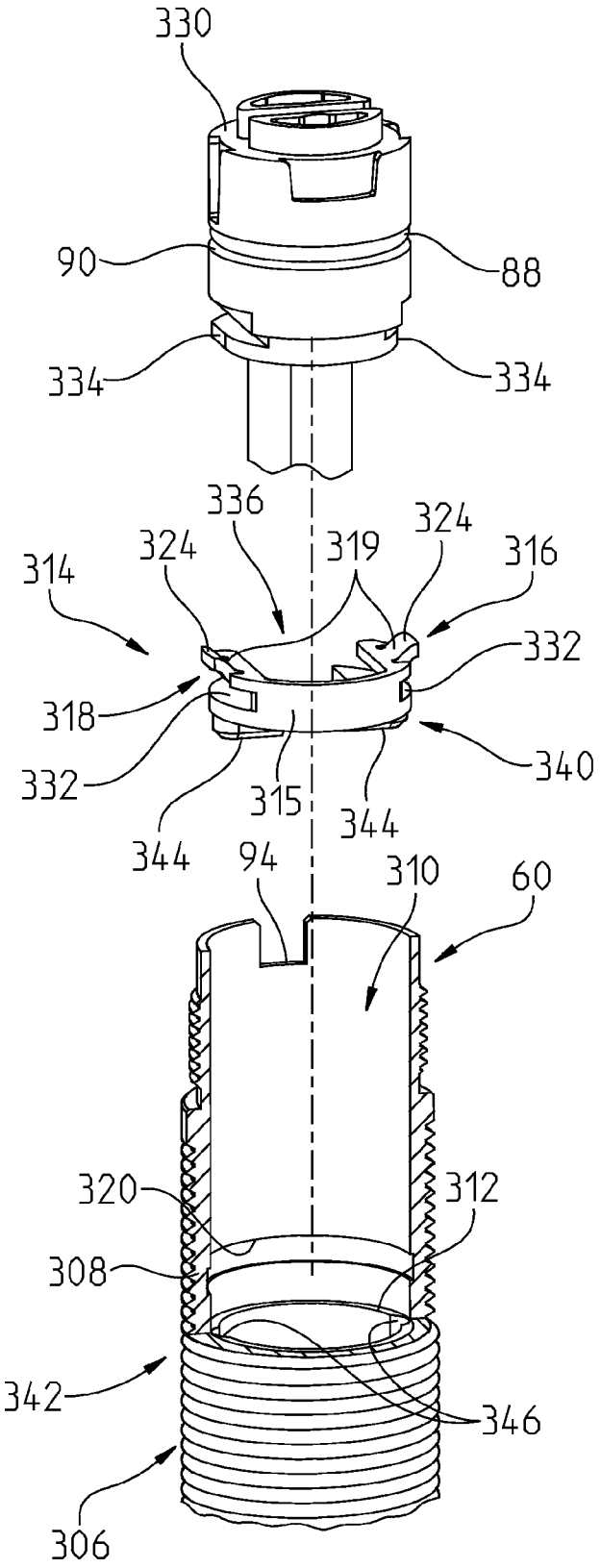
FIG. 16 is a front exploded perspective view, in partial cross-section, of the illustrative waterway, coupler, and valve body of the faucet assembly of FIG. 14.
Figure 17:
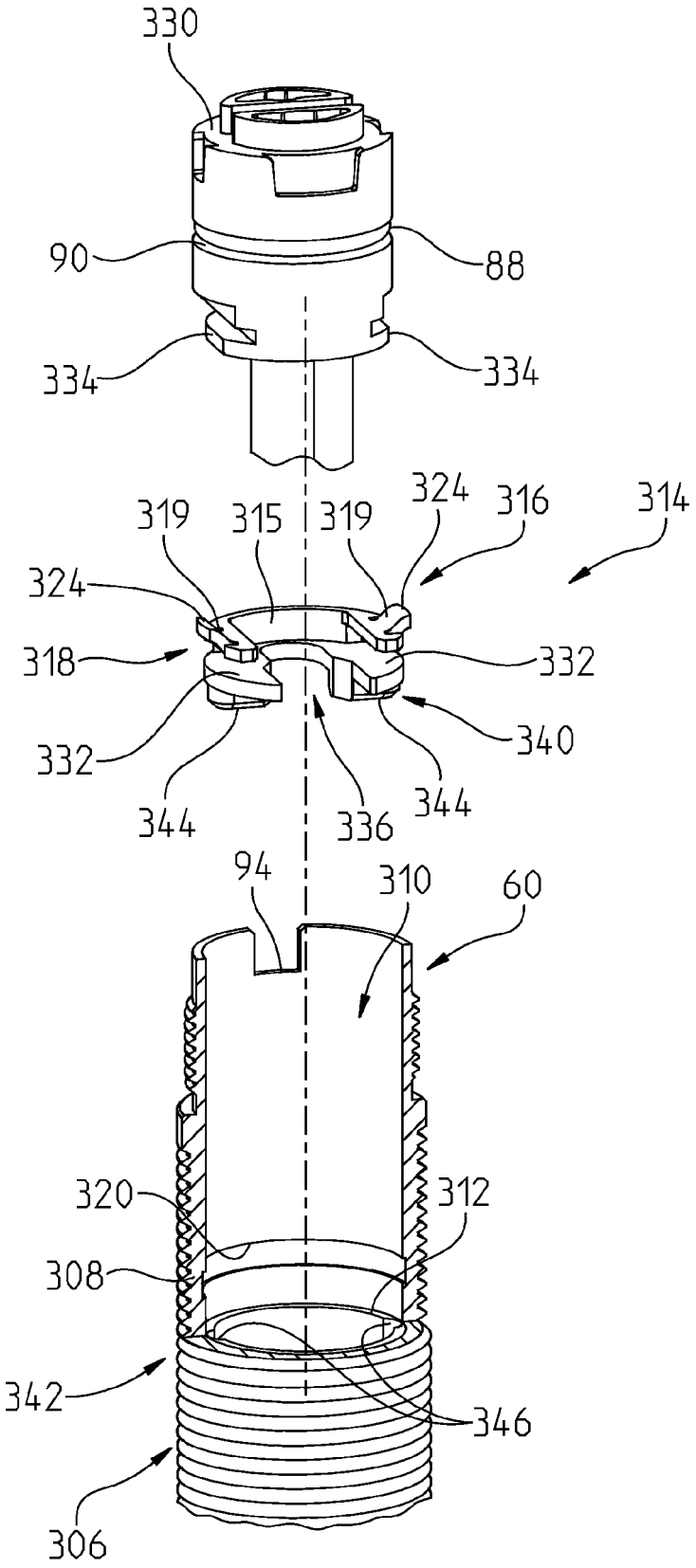
FIG. 17 is a rear exploded perspective view, in partial cross-section, similar to FIG. 16.
Figure 18:
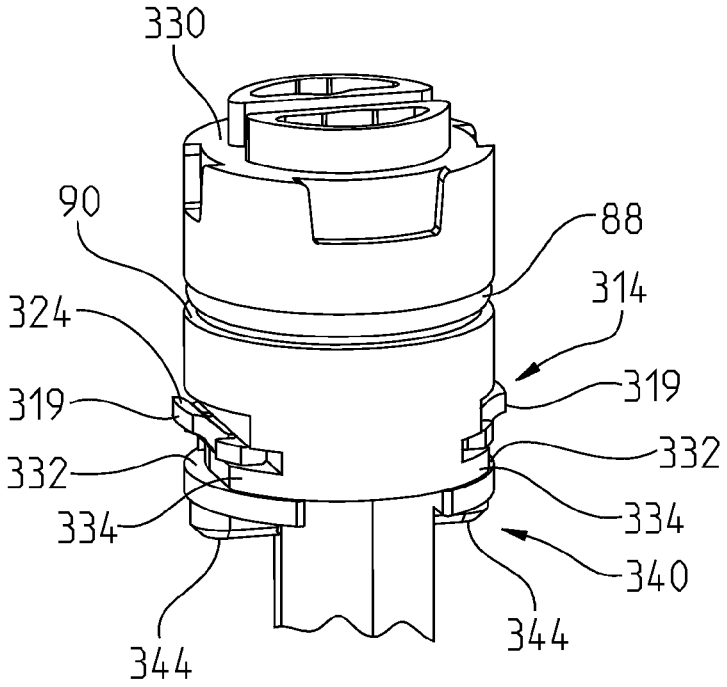
FIG. 18 is a rear perspective view of the coupler assembled to the waterway of FIG. 16.
Figure 19:
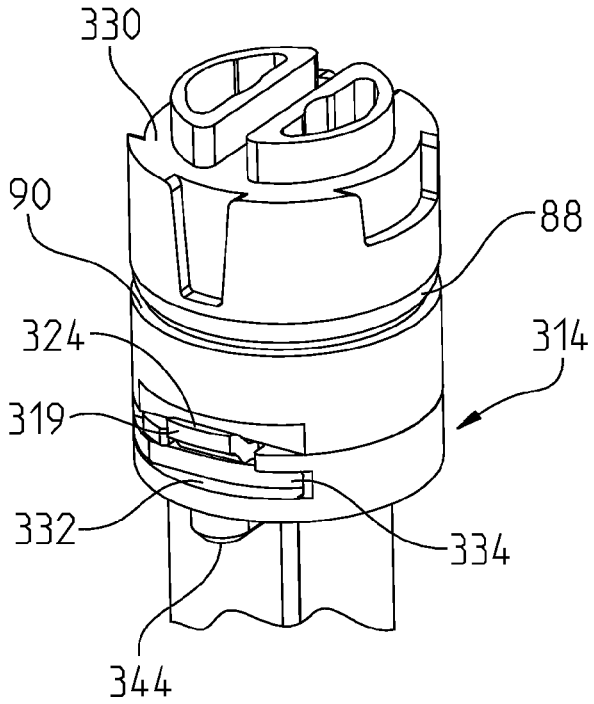
FIG. 19 is a side perspective view similar to FIG. 18.
Figure 20:
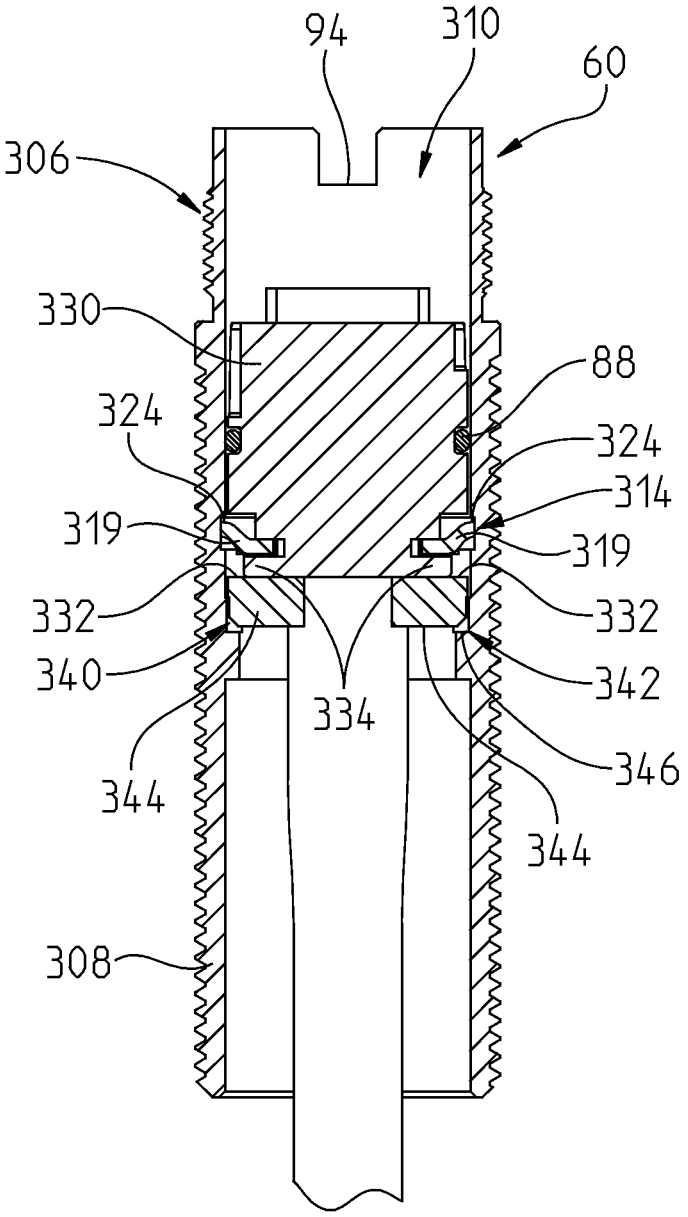
FIG. 20 is a longitudinal cross-sectional view of the waterway, coupler, and valve body of FIG. 16, showing the waterway coupled to the valve body by the coupler.

Each valve body or mounting shank 306 includes a substantially cylindrical sidewall 308. Illustratively, the valve body 306 is formed of metal, such as brass. The valve body 306 has a bore 310 extending therethrough and defining a ledge or annular lip 312 supporting the base 330 of the waterway assembly 328 (FIGS. 16, 17, and 20). More particularly, a coupler, illustratively a support clip 314, operably couples the base 330 to the valve body 306. The support clip 314 includes a body 315 having first and second retainers 316 and 318, respectively. Illustratively, the support clip 314 is formed of a polymer, such a polyamide, and the retainers 316 and 318 are integral with the body 315. In one illustrative embodiment, the support clip 314 is molded from a glass fiber reinforced polyamide resin, such as Zytel® 77G33L available from DuPont Engineering Polymers of Wilmington, Del.

As shown in FIGS. 16-20, the first retainers 316 of the support clip 314 illustratively include a pair of diametrically opposed resilient arms 319 extending outwardly from the body 315 and which are configured to snap into an annular groove 320 machined into the sidewall 308 of the valve body 306. The retainers 316 are illustratively biased outwardly from the base 330. Each arm 319 is illustratively angled to facilitate insertion into the groove 320, and includes a retaining ledge or lip 324 to prevent removal therefrom. Such engagement will keep the base 330 from being pushed out of the body 306 if the valve cartridge 26 is removed for service and the conduits 36, 38 are coiled and pushed upward after being installed.

The second retainers 318 of the support clip 314 illustratively comprises a pair of diametrically opposed slots 332 for slidably receiving tabs 334 formed near a lower end of the base 330. The body 315 of the support clip 314 is substantially U-shaped and defines an open end 336 for receiving the base 330 of the waterway 328. The tabs 334 of the base 330 cooperate with the slots 332 to facilitate proper rotational alignment or orientation of the waterway 28 relative to the support clip 314. As with base 230, base 330 may comprise a polymer overmolded around the ends 32 and 34 of the supply conduit 36 and the outlet conduit 38. The tabs 334 are illustratively integrally formed as part of the overmold of base 330. As further detailed herein, each valve cartridge 26 includes diametrically opposed alignment tabs or keys 92 which are received within cooperating recesses or notches 94 formed at the upper end 60 of the valve body 306, such that the handle 14 is properly aligned for use (FIG. 15).

With further reference to FIGS. 16-20, orientation members 340 and 342 illustratively cooperate to facilitate proper rotational alignment or orientation of the base 330 of the waterway 328 relative to the valve body 306. In the illustrative embodiment, orientation member 340 includes a pair of diametrically opposed protrusions or projections 344 extending downwardly from the body 315 of the support clip 314. The projections 344 engage in a pair of diametrically opposed recesses 346 formed in the sidewall 308 of the valve body 306 and defining orientation member 342. As such, the base 330 of the waterway 328 is rotationally keyed to the support clip 314 and, subsequently to the valve body 306.

Referring further to FIGS. 14, 15, and 21, a mounting member or shank 352 includes a flange 354 for mounting to the spout 18 through the use of fasteners 136, such as screws, while retaining finish flange or escutcheon 138. The spout 18 is illustratively secured to the deck 12 through the use of a washer 360 and a nut 142 threadably engaging external threads 144 on a downwardly extending tubular portion 365 of the mounting shank 352. The flange 354 includes a recess or notch 364 (FIG. 15) configured to position the outlet conduit 120 relative to a lift rod 148, which is received within the tubular portion 365 of the mounting shank 352 and is operably coupled to a conventional pop-up drain assembly (not shown). In a similar manner, the washer 360 illustratively includes a notch 366 to position the outlet conduit 120 relative to the tubular portion 365 of the mounting shank 352. In certain illustrative embodiments, the flange 354 and/or washer 360 may include multiple notches 364 and/or 366, respectively, to provide flexibility in placement of the outlet conduit 120.

The inlet end 128 of the outlet conduit 120 is in fluid communication with the hot and cold water supply conduits 38*a* and 38*b* through a connector 370. The connector 370 may be similar to connector 130 as detailed herein. In certain illustrative embodiments, the connector 370 may be a W fitting available from John Guest International Ltd.

With reference to FIGS. 15 and 21, optional spacers or bushings 372*a*, 372*b* may be positioned within the mounting openings 58*a*, 58*b* of the sink deck 12 to assist in centering of the valve bodies 306*a*, 306*b*, and therefore the water control assemblies 302, 304, relative to openings 58*a*, 58*b*. Similarly, a spacer or bushing 374 may be positioned within mounting opening 58*c* of the sink deck 12 to assist in centering of the tubular portion 365 of the mounting shank 352, and therefore the spout 18, relative to opening 58*c*. Bushings 372 and 374 would generally be used only when the respective mounting openings 58 within the sink deck 12 are oversized.

Although the invention has been described in detail with reference to certain preferred embodiments, variations and modifications exist within the spirit and scope of the invention as described and defined in the following claims.

The invention claimed is:

1. A faucet assembly comprising:

a waterway including a conduit having opposing first and second ends, and a base coupled to the first end of the conduit;

a valve assembly operably coupled to the base and in fluid communication with the conduit;

a valve body including a sidewall receiving the base of the waterway, the valve assembly operably coupled to an upper end of the valve body, and the conduit extending through a lower end of the valve body; and a first retainer integral with the sidewall of the valve body and configured to prevent movement of the base of the waterway toward the upper end of the valve body, and a second retainer integral with the sidewall of the valve body and configured to prevent movement of the base of the waterway toward the lower end of the valve body.

2. The faucet assembly of claim 1, wherein the conduit is formed of a polymer, and the base is a polymer overmold.

3. The faucet assembly of claim 1, further comprising a spacer received within the valve body and extending between the base and the second retainer.

4. The faucet assembly of claim 3, wherein:

the waterway includes a first orientation member; and the spacer includes a second orientation member cooperating with the first orientation member to facilitate proper rotational orientation of the base of the waterway.

5. The faucet assembly of claim 1, wherein the first retainer comprises an annular flange extending inwardly from an inner surface of the sidewall of the valve body.

6. The faucet assembly of claim 1, wherein the second retainer comprises a bent annular edge of the sidewall of the valve body, the bent edge applying an upward load to the base of the waterway.

7. The faucet assembly of claim 1, further comprising an o-ring extending between the base of the waterway and the sidewall of the valve body.

8. A faucet assembly comprising:

a waterway including a conduit having opposing first and second ends, and a base coupled to the first end of the first conduit;

a valve assembly operably coupled to the base and in fluid communication with the conduit;

a valve body including a sidewall receiving the base of the waterway, the valve assembly operably coupled to an upper end of the valve body, and the conduit extending through a lower end of the valve body;

a first orientation member supported by the base of the waterway; and a second orientation member operably coupled to the first orientation member to facilitate proper rotational orientation of the base of the waterway.

9. The faucet assembly of claim 8, further comprising a spacer received within the valve body and supporting the base of the waterway, the second orientation member comprising a recess defined by the spacer, and the first orientation member comprising a protrusion formed by the base and receivable within the recess of the spacer.

10. The faucet assembly of claim 9, further comprising a retainer operably coupled to a lower end of the valve body to retain the spacer within the valve body.

11. The faucet assembly of claim 10, wherein the retainer comprises a bent annular edge of the sidewall of the valve body, the bent edge applying an upward load to the base of the waterway.

12. The faucet assembly of claim 8, further comprising an o-ring extending between the base of the waterway and the sidewall of the valve body.

13. The faucet assembly of claim 8, wherein the valve assembly includes at least one alignment key and the valve body includes at least one alignment recess, the at least one alignment key receivable within the at least one alignment recess to rotationally orient the valve assembly to the valve body.

14. A widespread faucet assembly comprising:

a hot water control valve;

a cold water control valve;

a hot water outlet conduit including an end in fluid communication with the hot water control valve;

a cold water outlet conduit including an end in fluid communication with the cold water control valve;

a fluid connector including a hot water inlet port, a cold water inlet port, and an outlet port, the end of the hot water outlet conduit received within the hot water inlet port, the end of the cold water outlet conduit received within the cold water inlet port;

an outlet conduit including an end received within the outlet port of the fluid connector;

a delivery spout positioned intermediate the hot water control valve and the cold water control valve, the outlet conduit received within the delivery spout;

a first clip configured to releasably couple the end of the hot water outlet conduit to the hot water inlet port of the fluid connector; and a second clip configured to releasably couple the end of the cold water outlet conduit to the cold water inlet port of the fluid connector.

15. The widespread faucet assembly of claim 14, wherein the outlet port of the fluid connector is positioned intermediate the hot water inlet port and the cold water inlet port, the hot water inlet port is angled in an upward direction away from the outlet port, and the cold water inlet port is angled in an upward direction away from the outlet port.

16. The widespread faucet assembly of claim 14, wherein each of the first clip and the second clip includes spring biased retaining legs received within a groove formed within the fluid connector, and retention blades extending through slots formed within the fluid connector and engagable with a coupler supported by the end of the respective hot water outlet conduit and cold water outlet conduit.

17. A widespread faucet assembly comprising:

a hot water control valve;

a cold water control valve;

a hot water outlet conduit including an end in fluid communication with the hot water control valve;

a cold water outlet conduit including an end in fluid communication with the cold water control valve;

a fluid connector including a hot water inlet port, a cold water inlet port, and an outlet port, the end of the hot water outlet conduit received within the hot water inlet port, the end of the cold water outlet conduit received within the cold water inlet port;

an outlet conduit including an end received within the outlet port of the fluid connector;

a delivery spout positioned intermediate the hot water control valve and the cold water control valve, the outlet conduit received within the delivery spout; and wherein the outlet port includes a plurality of teeth configured to engage the end of the outlet conduit.

18. A faucet assembly comprising:

a waterway including a conduit having an end, and a base coupled to the end of the conduit;

a valve assembly operably coupled to the base and in fluid communication with the conduit;

a valve body including a sidewall receiving the base of the waterway and including a retaining recess; and a retainer supported by the base and configured to be received within the retaining recess of the valve body to angularly align the base with the valve body.

19. The faucet assembly of claim 18, wherein the retainer includes an inclined surface and a retaining lip configured to snap into the retaining recess.

20. The faucet assembly of claim 18, wherein the retainer is integrally formed with the base of the waterway.

21. The faucet assembly of claim 20, wherein the retainer and the base are formed of a polymer.

22. The faucet assembly of claim 21, wherein the conduit is formed of a polymer, and the base is a polymer overmold.

23. The faucet assembly of claim 18, further comprising an o-ring extending between the base of the waterway and the sidewall of the valve body.

24. The faucet assembly of claim 18, further comprising an outlet conduit having an end, the base coupling together the ends of the inlet and outlet conduits.

25. The faucet assembly of claim 18, wherein the retainer angularly aligns the base with the valve body.

26. A widespread faucet assembly comprising:

a mounting base including a first opening and a second opening spaced apart from the first opening, the first opening and the second opening each including an alignment member, the mounting base configured to be operably coupled beneath a sink deck;

a first mounting shank received within the first opening and including a cooperating member to cooperate with the alignment member of the first opening for rotationally aligning the first mounting shank within the mounting base;

a second mounting shank received within the second opening and including a cooperating member to cooperate with the alignment member of the second opening for rotationally aligning the second mounting shank within the mounting base;

a first valve assembly operably coupled to the first mounting shank, the first valve assembly including an alignment member configured to cooperate with the first mounting shank to provide rotational alignment therebetween; and a second valve assembly operably coupled to the second mounting shank, the second valve assembly including an alignment member to cooperate with the second mounting shank to provide rotational alignment therebetween.

27. A widespread faucet assembly comprising:

a mounting base including a first opening and a second opening spaced apart from the first opening, the first opening and the second opening each including an alignment member, the mounting base configured to be operably coupled to a sink deck;

a first mounting shank received within the first opening and including a cooperating member to cooperate with the alignment member of the first opening for rotationally aligning the first mounting shank within the mounting base;

a second mounting shank received within the second opening and including a cooperating member to cooperate with the alignment member of the second opening for rotationally aligning the second mounting shank within the mounting base; and a delivery spout and a spout mounting shank operably coupling the delivery spout to the sink deck, the mounting base including a third opening positioned intermediate the first opening and the second opening and receiving the spout mounting shank.

28. A widespread faucet assembly comprising:

a mounting base including a first opening and a second opening spaced apart from the first opening, the first opening and the second opening each including an alignment member, the mounting base configured to be operably coupled to a sink deck;

a first mounting shank received within the first opening and including a cooperating member to cooperate with the alignment member of the first opening for rotationally aligning the first mounting shank within the mounting base;

a second mounting shank received within the second opening and including a cooperating member to cooperate with the alignment member of the second opening for rotationally aligning the second mounting shank within the mounting base;

a first waterway including an inlet conduit having an end, and a base coupled to the end of the conduit, the first valve assembly operably coupled to the base and in fluid communication with the inlet conduit;

a first retainer supported by the base and configured to be received within a retaining recess of the first mounting shank to align the base with the first mounting shank;

a second waterway including an inlet conduit having an end, and a base coupled to the end of the conduit, the second valve assembly operably coupled to the base and in fluid communication with the inlet conduit; and a second retainer supported by the base and configured to be received within a retaining recess of the second mounting shank to align the base with the second mounting shank.

29. The widespread faucet assembly of claim 28, wherein the first retainer includes an inclined surface and a retaining lip configured to snap into the retaining recess of the first mounting shank, and the second retainer includes an inclined surface a retaining lip configured to snap into the retaining recess of the second mounting shank.

30. The widespread faucet assembly of claim 28, wherein the first retainer is integrally formed with the base of the first waterway, and the second retainer is integrally formed with the base of the second waterway.

31. The widespread faucet assembly of claim 30, wherein the conduit of each of the first waterway and the second water is formed of a polymer, and the base of each of the first waterway and the second waterway is a polymer overmold.

32. The widespread faucet assembly of claim 28, further comprising:

a gasket positioned intermediate the first valve assembly and the base of the first waterway, and an o-ring extending between the base of the first waterway and the sidewall of the first mounting shank; and a gasket positioned intermediate the second valve assembly and the base of the second waterway, and an o-ring extending between the base of the second waterway and the sidewall of the second mounting shank.

33. A faucet assembly comprising;

a waterway including a conduit having an end, and a base coupled to the end of the conduit;

a valve assembly operably coupled to the base and in fluid communication with the conduit;

a valve body receiving the base of the waterway; and a coupler received within the valve body, the coupler including a first retainer coupled to the base of the waterway, and a second retainer coupled to the valve body; and wherein the base of the waterway includes a groove, and the first retainer of the coupler includes a tongue received within the groove of the waterway.

34. The faucet assembly of claim 33, further comprising an outlet conduit having an end, the base coupling together the ends of the inlet conduit and the outlet conduit.

35. A faucet assembly comprising;

a waterway including a conduit having an end, and a base coupled to the end of the conduit;

a valve assembly operably coupled to the base and in fluid communication with the conduct;

a valve body receiving the base of the waterway; and a coupler received within the valve body, the coupler including a first retainer coupled to the base of the waterway, and a second retainer coupled to the valve body; and wherein the valve body includes a sidewall having a retaining recess, and the second retainer of the coupler includes a resilient arm received within the retaining recess of the valve body.

36. The faucet assembly of claim 35, wherein the resilient arm of the second retainer includes an inclined surface and a lip configured to snap into the retaining recess of the valve body.

37. A faucet assembly comprising;

a waterway including a conduit having an end, and a base coupled to the end of the conduit;

a valve assembly operably coupled to the base and in fluid communication with the conduct;

a valve body receiving the base of the waterway;

a coupler received within the valve body, the coupler including a first retainer coupled to the base of the waterway, and a second retainer coupled to the valve body; and wherein the coupler is formed of a polymer.

38. A faucet assembly comprising;

a waterway including a conduit having an end, and a base coupled to the end of the conduit;

a valve assembly operably coupled to the base and in fluid communication with the conduct;

a valve body receiving the base of the waterway;

a coupler received within the valve body, the coupler including a first retainer coupled to the base of the waterway, and a second retainer coupled to the valve body; and wherein the conduit is formed of a polymer, and the base is a polymer overmold.

39. A faucet assembly comprising:

a waterway including a conduit having an end, and a base coupled to the end of the conduit;

a valve assembly operably coupled to the base and in fluid communication with the conduct;

a valve body receiving the base of the waterway;

a coupler received within the valve body, the coupler including a first retainer coupled to the base of the waterway, and a second retainer coupled to the valve body; and a gasket positioned intermediate the valve assembly and the base of the waterway to define a face seal, and an o-ring extending between the base of the waterway and the valve body to define a radial seal.

40. A faucet assembly comprising:

a waterway including a conduit having an end, and a base coupled to the end of the conduit;

a valve assembly operably coupled to the base and in fluid communication with the conduct;

a valve body receiving the base of the waterway;

a coupler received within the valve body, the coupler including a first retainer coupled to the base of the waterway, and a second retainer coupled to the valve body;

a first orientation member supported by the coupler; and a second orientation member supported by the valve body and operably coupled to the first orientation member to facilitate proper rotational orientation of the base of the waterway relative to the valve body.

41. The faucet assembly of claim 40, wherein the second orientation member comprises a slot supported by the valve body, and the first orientation member comprises a protrusion formed by the coupler and receivable within the slot of the valve body.

42. A widespread faucet assembly comprising:

a hot water control valve;

a cold water control valve;

a flexible hot water inlet conduit including an end in fluid communication with the hot water control valve;

a flexible cold water inlet conduit including an end in fluid communication with the cold water control valve;

a flexible hot water outlet conduit including an end in fluid communication with the hot water control valve;

a flexible cold water outlet conduit including an end in fluid communication with the cold water control valve;

a first mounting shank configured to be secured to a mounting deck, the hot water inlet conduit and the hot water outlet conduit extending within the first mounting shank;

a second mounting shank configured to be secured to the mounting deck in spaced relation to the first mounting shank, the cold water inlet conduit and the cold water outlet conduit extending within the second mounting shank;

a fluid connector including a hot water inlet port, a cold water inlet port, and an outlet port, the end of the hot water outlet conduit received within the hot water inlet port, the end of the cold water outlet conduit received within the cold water inlet port;

an outlet conduit including an end received within the outlet port of the fluid connector; and a delivery spout positioned intermediate the hot water control valve and the cold water control valve, the outlet conduit received within the delivery spout.

* * * * *